United States Patent [19]

Jureit et al.

[11] 4,025,028

[45] May 24, 1977

[54] BOX SPRING FRAME MACHINE

[75] Inventors: John Calvin Jureit, Coral Gables; Adolfo Castillo, Miami; Roy Leutwyler, Miami; Benjamin H. Kushner, Miami; Larry Brodsky, Sunrise, all of Fla.

[73] Assignee: Automated Building Components, Inc., Miami, Fla.

[22] Filed: Feb. 21, 1975

[21] Appl. No.: 551,990

Related U.S. Application Data

[63] Continuation-in-part of Ser. No. 488,006, July 12, 1974, Pat. No. 3,913,816, which is a continuation of Ser. No. 317,095, Dec. 20, 1972, abandoned.

[52] U.S. Cl. ..... 227/7; 227/95; 227/103

[51] Int. Cl.[2] ..... B27F 7/00

[58] Field of Search ..... 227/3, 5, 6, 7, 44, 227/45, 48, 50, 95, 99, 100, 101, 103, 153

[56] References Cited

UNITED STATES PATENTS

| | | | |
|---|---|---|---|
| 3,086,210 | 4/1963 | Good et al. | 227/99 |
| 3,567,099 | 3/1971 | Winters | 227/100 |
| 3,606,130 | 9/1971 | De Lamar et al. | 227/45 |
| 3,873,015 | 3/1919 | Whitaker | 227/100 |
| 3,913,816 | 10/1975 | Jureit et al. | 227/95 |

*Primary Examiner*—Granville Y. Custer, Jr.
*Attorney, Agent, or Firm*—LeBlanc & Shur

[57] ABSTRACT

The apparatus includes slat and rail conveyors which pick up slats and rails from respective hoppers on the input side of the machine and convey the slats and rails into joint forming positions between vertically opposed pressheads mounted on opposite sides of the machine. Coils of connector plate stock, having prepunched integrally extending teeth, feed each of the upper and lower press platens and which platens are movable toward one another to substantially simultaneously cut the connector stock to predetermined lengths to form connector plates and embed the teeth of the connector plates into opposite sides of the joints formed by the rails and slats disposed between the pressheads. In the automatic mode, the partially completed frame is advanced a predetermined distance and a second slat is located between the side rails whereupon the pressheads are automatically actuated to cut discrete connector plates from the connector stock and embed the teeth thereof into the opposite sides of the second slat and rails. The sequence of operation continues until the first frame is substantially completed. The machine then automatically spaces the rails of successive frames longitudinally one from the other and when the first frame is complete, automatically commences fabrication of the second and subsequent frames.

31 Claims, 20 Drawing Figures

A
B
C
316R
316L
324R
324L
362R
362L
206R
206L
230R
230L
232R
232L
534R
534L
542R
542L
384R
384L
342R
342L
112R
112L
176R
176L
380
382
388
390
392
394
396
398
400
402
404
406
408
409
410
411
412
413
414
415
416
417
418
419
420
421
422
423
424
425
426
427
428
429
430
431
432
434
436
438
440
442
444
446
450
452
558
586
638

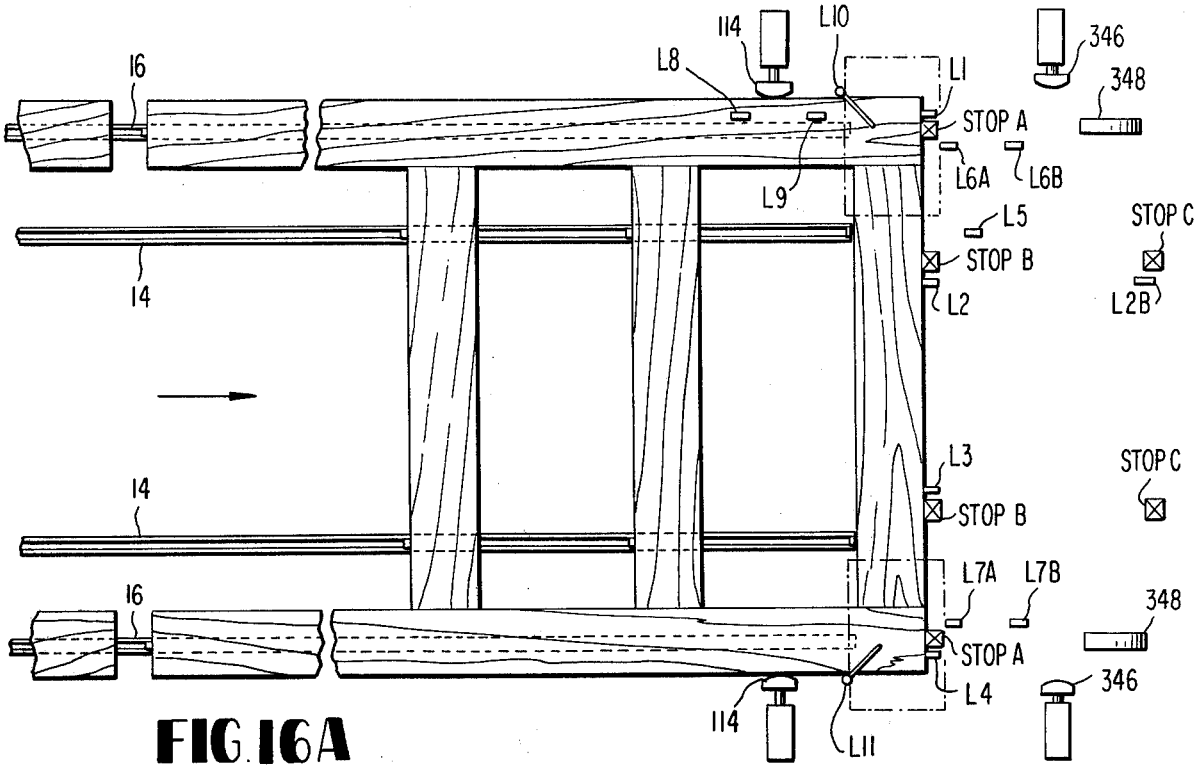
FIG. 16A
FIG. 16B
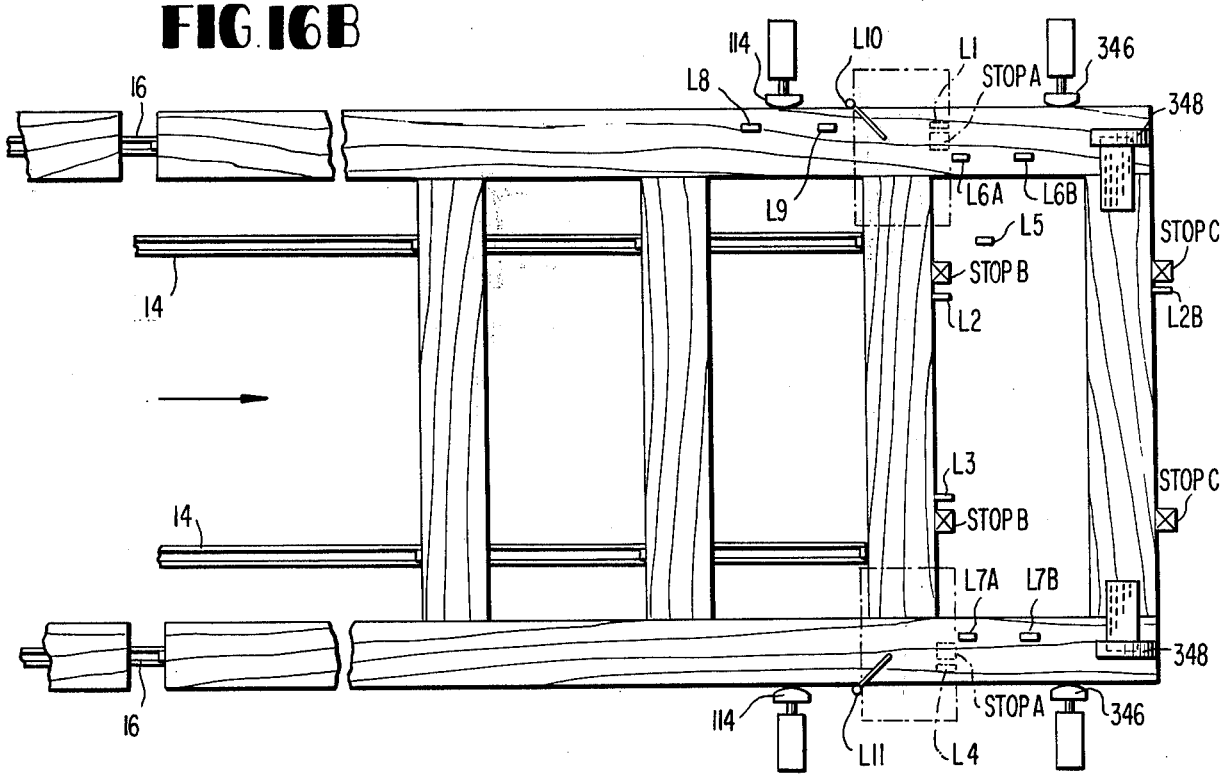

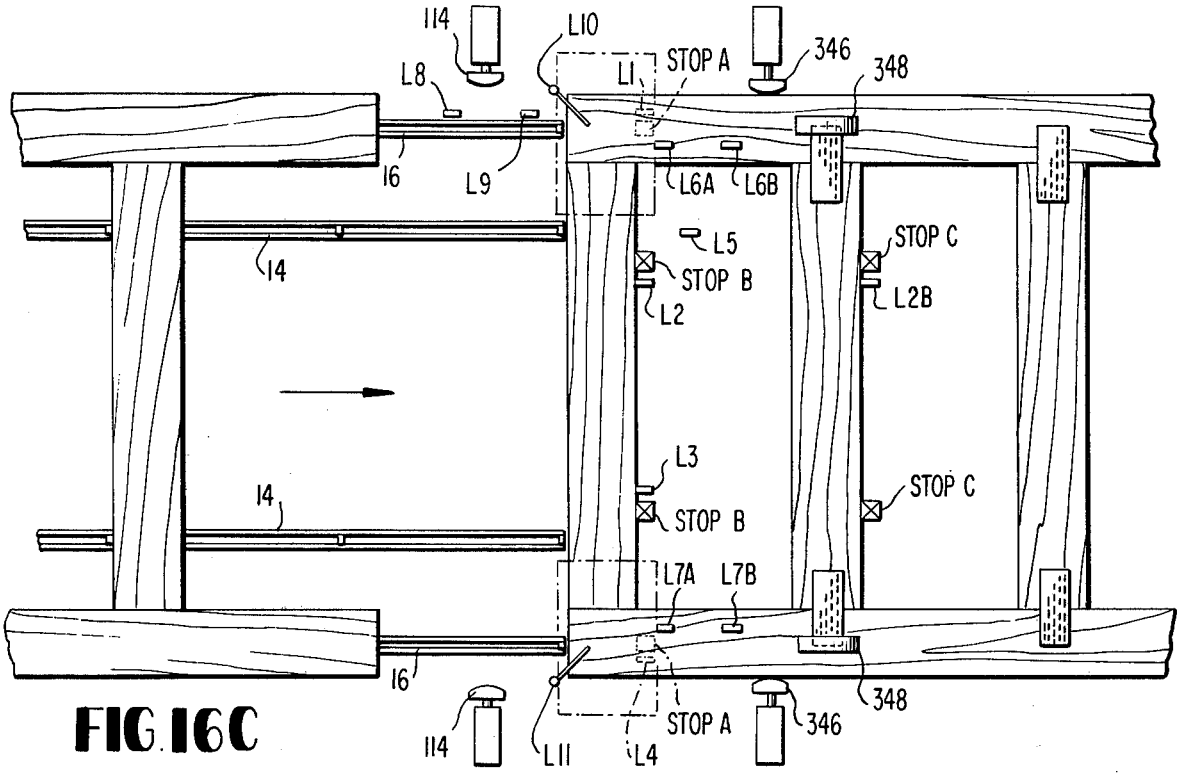
FIG. 16C
FIG. 16D
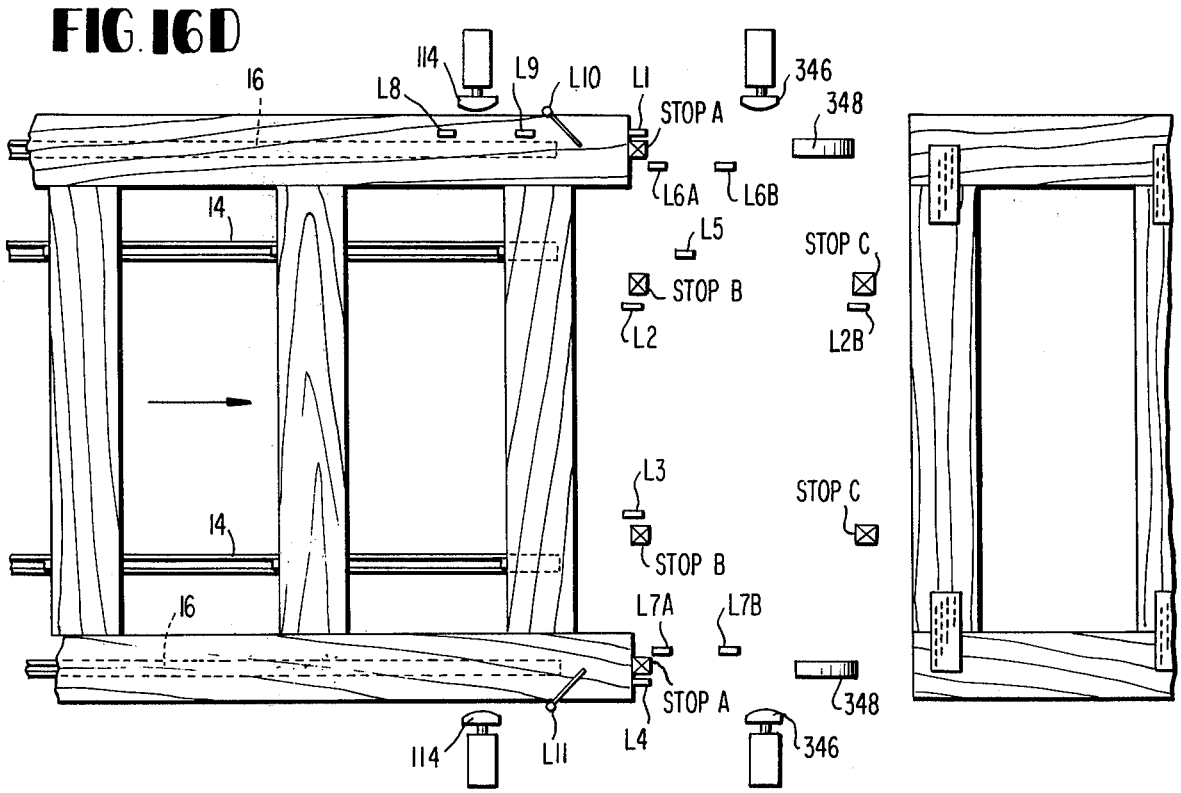

BOX SPRING FRAME MACHINE

This application is a continuation-in-part of co-pending application Ser. No. 488,006, filed on July 12, 1974, and now U.S. Pat. No. 3,913,816, issued Oct. 21, 1975, as a continuation of Ser. No. 317,095, filed on Dec. 20, 1972, now abandoned.

The present invention relates to apparatus for forming wooden frames and the like and particularly relates to apparatus for providing discrete connector plates of the type having prepunched integrally extending teeth from coiled strips thereof and substantially simultaneously embedding the plates into the opposite sides of joints of prepositioned wooden members to fabricate a frame, for example a box spring frame for bedding.

It is currently common practice to utilize connector plates of the type having integrally struck teeth to form the joints between various members comprising a wooden frame. For example, connector plates of various sizes and widths, depending upon the structural requirements of the frames, are commonly embedded into the joints of wooden roof trusses and truss-type floor joints. An example of such connector plate is disclosed in U.S. Pat. No. 2,877,520 of common assignee herewith. Significant strides forward have been accomplished in this industry by the advent of apparatus which acts on coiled connector plate stock of the type having teeth struck integrally therefrom to cut the stock to discrete predetermined lengths and substantially simultaneously embed the teeth of the cut stock or connector plate formed thereby into the opposite sides of a joint formed between wooden frame members. Such apparatus is described and illustrated in U.S. Pat. application Ser. No. 488,006 filed July 12, 1974, and now U.S. Pat. No. 3,913,816 of common assignee herewith. As disclosed in that application, there is provided a machine on which are mounted coils of connector plate stock and which coils constitute a magazine from which the stock is fed to the machine. The machine includes a feed assembly which unwinds the coils and advances leading portions of the coils discrete distances toward a press cut-off assembly, each advance corresponding in distance to the length of the desired connector plate. A pair of such assemblies are provided on opposite sides of a conveyor and each such assembly includes opposed pressheads mounted for movement toward and away from the joints between web and chord members manually located between the pressheads along opposite sides of the conveyor. In that machine, and on each side of the frame to be fabricated, two discrete lengths of connector strip are cut from the connector stock of the respective coils feeding the upper and lower pressheads and the teeth of the connector plates thus formed are substantially simultaneously embedded into the opposite sides of the joint formed by the web and chords. Once the pressheads are retracted, the feed assembly automatically advances the connector plate stock to position discrete lengths of such stock for subsequent cutoff and embedment of the teeth thereof into a subsequent joint. The partially completed frame is advanced manually and a web is manually disposed between the trailing ends of the chords. The foregoing described operation is repeated and a rectangular frame is thus formed. This machine has performed satisfactorily and is in current use.

It will be appreciated, however, that the manual feed of the lumber forming the opposite chords and webs as well as manual initiation of each press-cutoff cycle limits the producitive capacity of such machine. Moreover, such machine is designed for the formation of a generally rectangular frame without intermediate web members.

Generally the present invention provides novel and improved apparatus for automatically forming a plurality of frames, particularly wooden frames of the type having a pair of side rails and a plurality of members or slats extending therebetween at longitudinally spaced positions relative thereto. Generally, the machine of the present invention comprises a pair of generally C-shaped frames on opposite sides of a conveyor with each frame mounting vertically opposed pressheads. Coils of connector plate stock are carried by the frames and are fed to cutoff blades adjacent each of the upper and lower heads on opposite sides of the conveyor. The conveyor includes both slat and rail conveyors whereby the slats and rails are continuously advanced to and past the presshead positions. Stops are located in the path of movement of the rails and slats to locate the first slat and endwise related rails in position such that the joints formed thereby lie between the pressheads on opposite sides of the conveyor. After the initial command to commence fabrication is given, the pressheads are moved toward one another to cut the connector stock to form the connector plates of discrete lengths whereupon continued movement of the presshead embeds the teeth of the discrete connector plates into the opposite sides of the joint formed between the slat and the rails. When the pressheads are retracted, the rail and slat stops are retracted enabling the partially completed frame with one slat and two rails to advance until the first slat butts a second stop. The next slat is carried by the slat conveyor until it butts the stops directly adjacent the pressheads whereby the second slat is located relative to the rails with the joints between the second slat and rails located between the opposed pressheads. Additional lengths of coiled connector stock are advanced to locate additional lengths of connector plate stock in the path of movement of the pressheads. The pressheads are thereafter automatically actuated to cut the connector plate stock to form connector plates of discrete lengths and continued movement of the pressheads carries the plates such that the teeth thereof are embedded into the joints formed between the second slat and the rails. The pressheads thereafter retract and the partially complete frame is automatically advanced whereupon the machine continuously cycles to form the joints between additional slats and the side rails of a particular frame.

Prior to nailing the last slat in the frame, the machine hereof automatically spaces the leading ends of the pair of rails which will form the next frame from the trailing ends of the rails of the preceding partially completed frame. When the last slat of the first frame is secured to the trailing end of the rails, the completed frame is advanced from the press position and the first slat and leading ends of the rails which will form the next frame are advanced into the press position. The foregoing described cycle of operation continues so long as there is coiled connector stock available and rails and slats in the hoppers for feeding the input slat and rail conveyors.

Accordingly, it is a primary object of the present invention to provide novel and improved apparatus for fabricating wooden frames and the like.

It is another object of the present invention to provide novel and improved apparatus for automatically fabricating wooden frames of the type having a multiplicity of elements between a pair of side elements.

It is still another object of the present invention to provide novel and improved apparatus for substantially simultaneously cutting connector plates of the type having integrally struck teeth from a coiled strip thereof and embedding the teeth of the connector plates into the multiple joints of a wooden frame.

It is a further object of the present invention to provide a novel and improved machine for fabricating wooden frames of the type having a pair of side rails and a plurality of slats longitudinally spaced between the side rails and wherein the joints thereof are automatically joined and suceeding frames of identical type automatically fabricated.

These and further objects and advantages of the present invention will become more apparent upon reference to the following specification, appended claims and drawings wherein:

Figure 7:
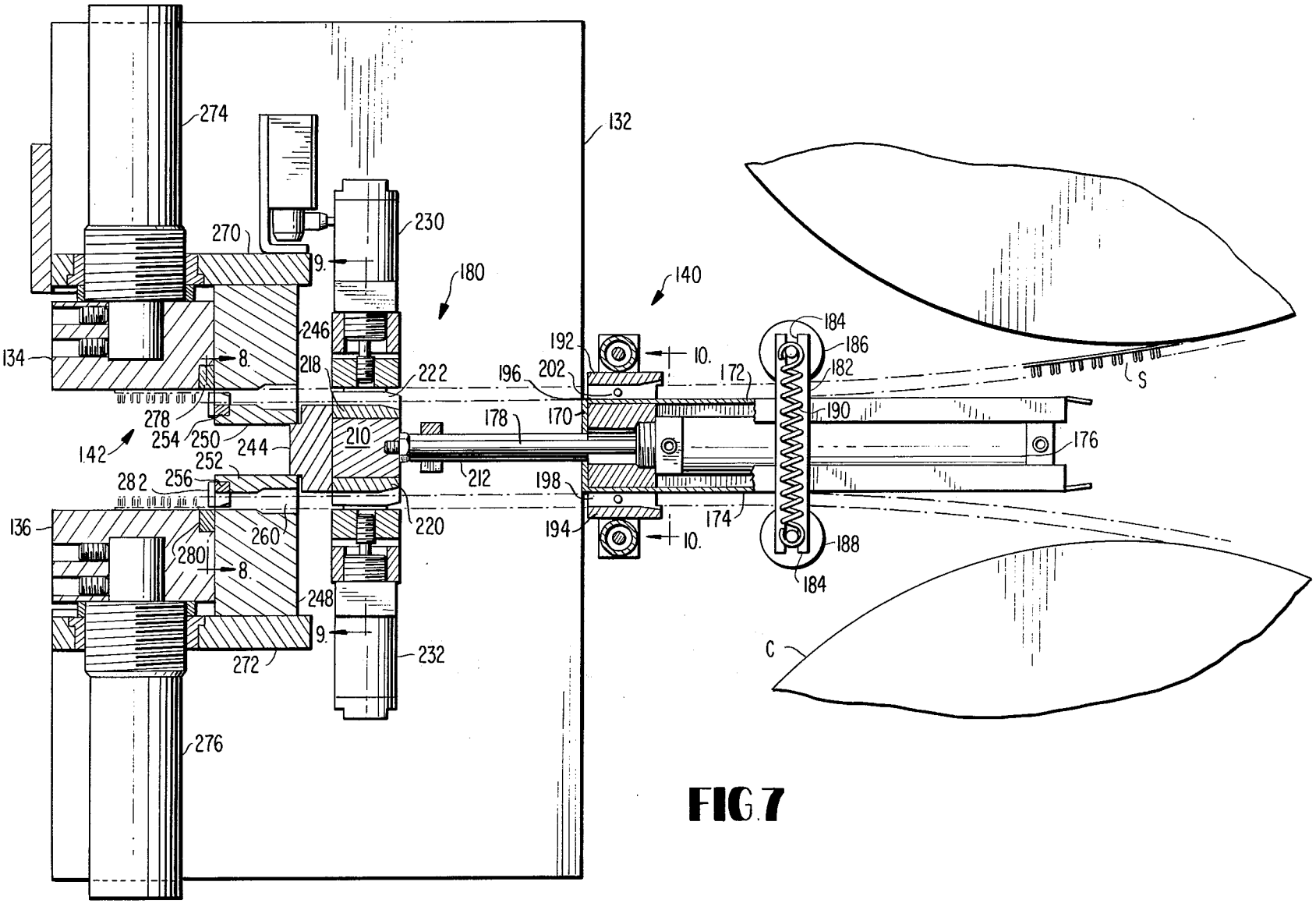
FIG. 7 is an enlarged fragmentary cross-sectional view of a feed and press assembly forming a part of the fabricating machine illustrated in FIG. 1.
Figure 10:
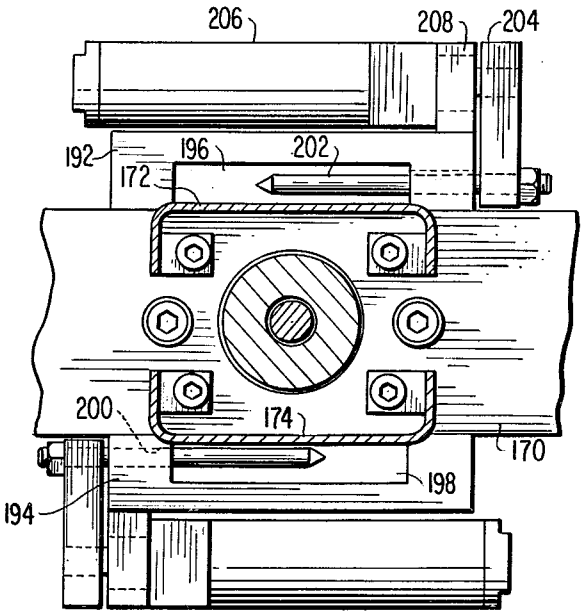
Figure 9:
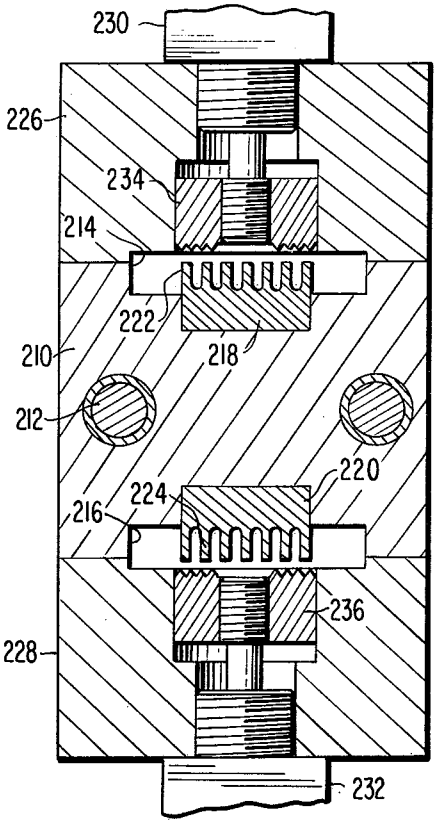
Figure 8:
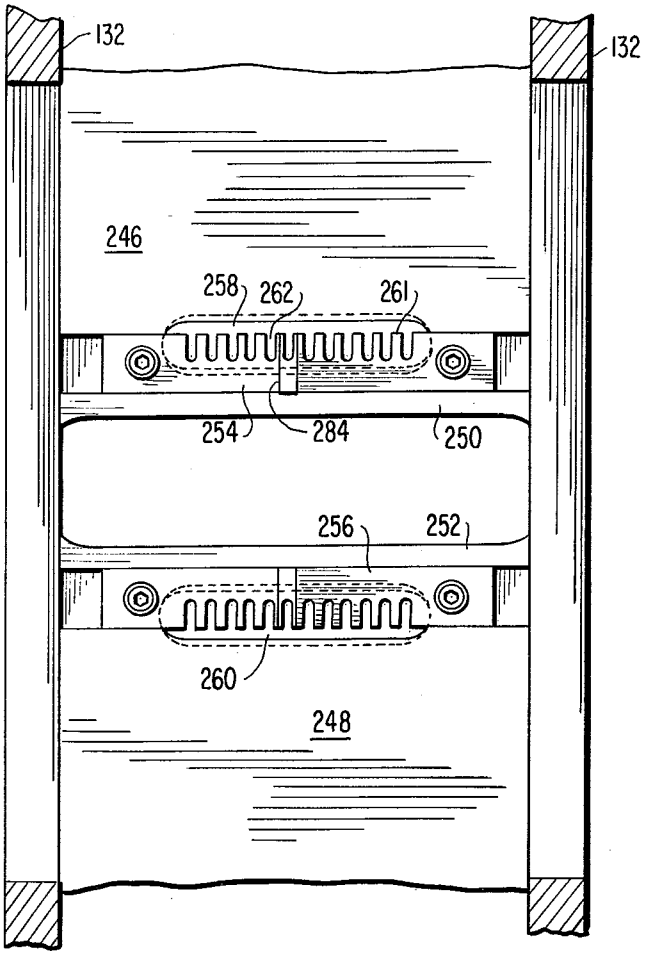
Figure 12:
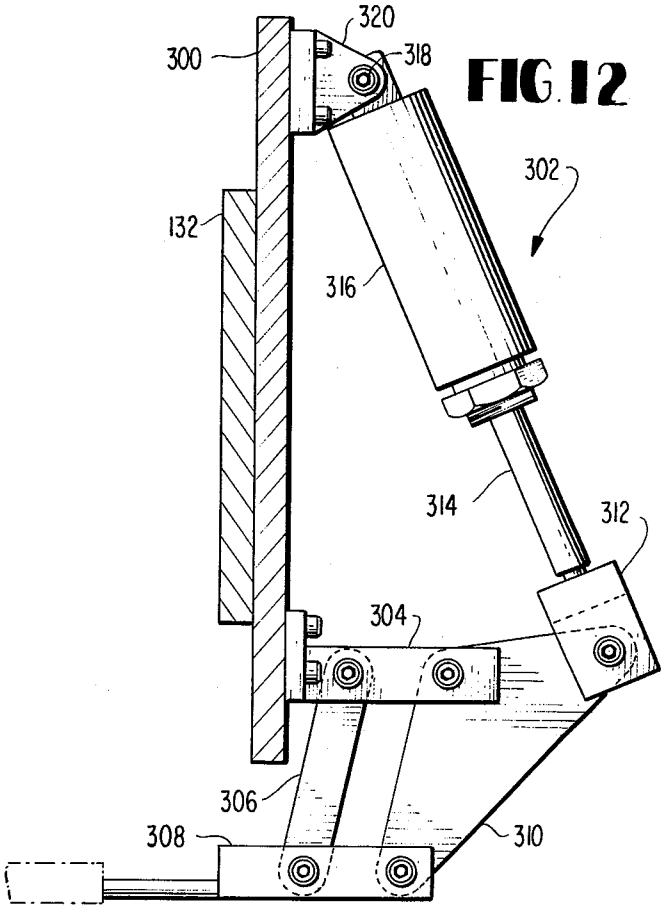
Figure 11:
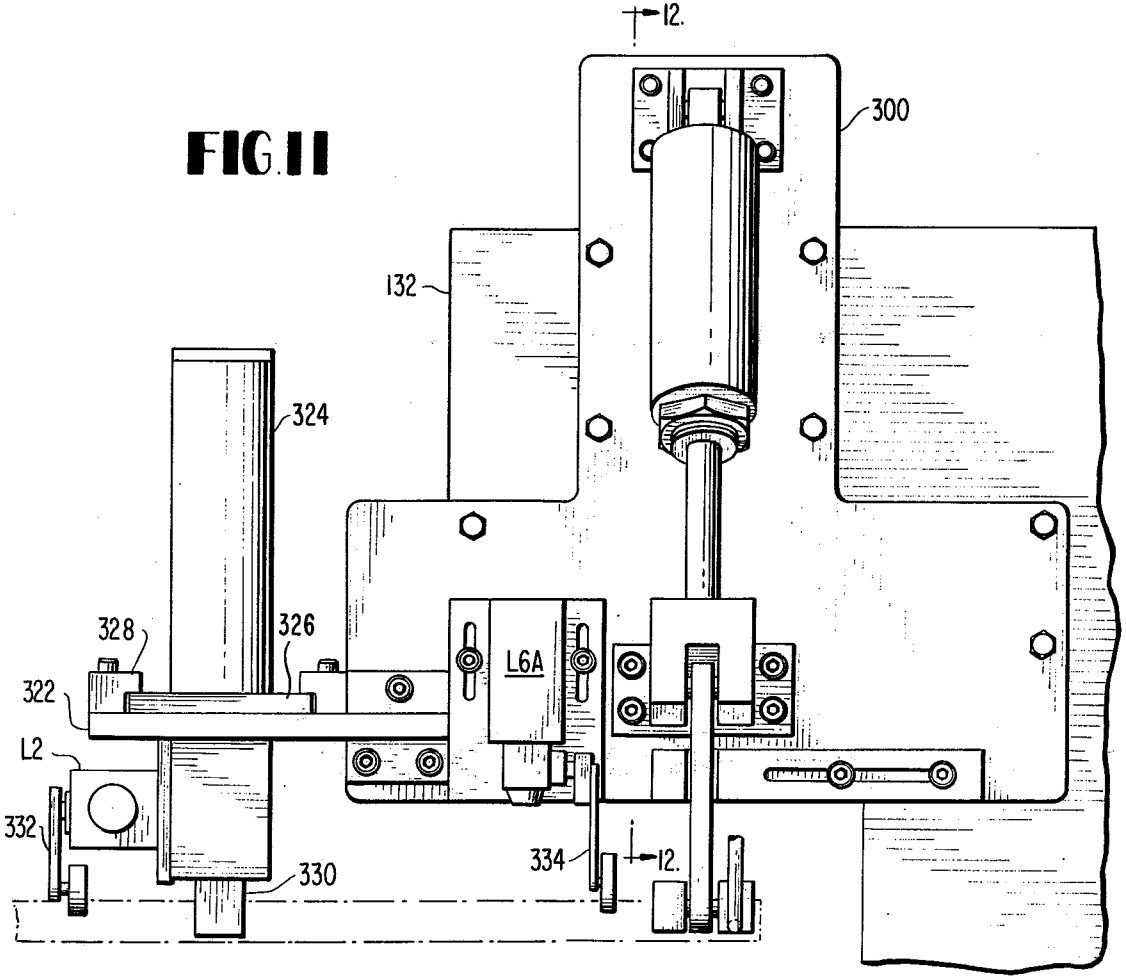
Figure 13:
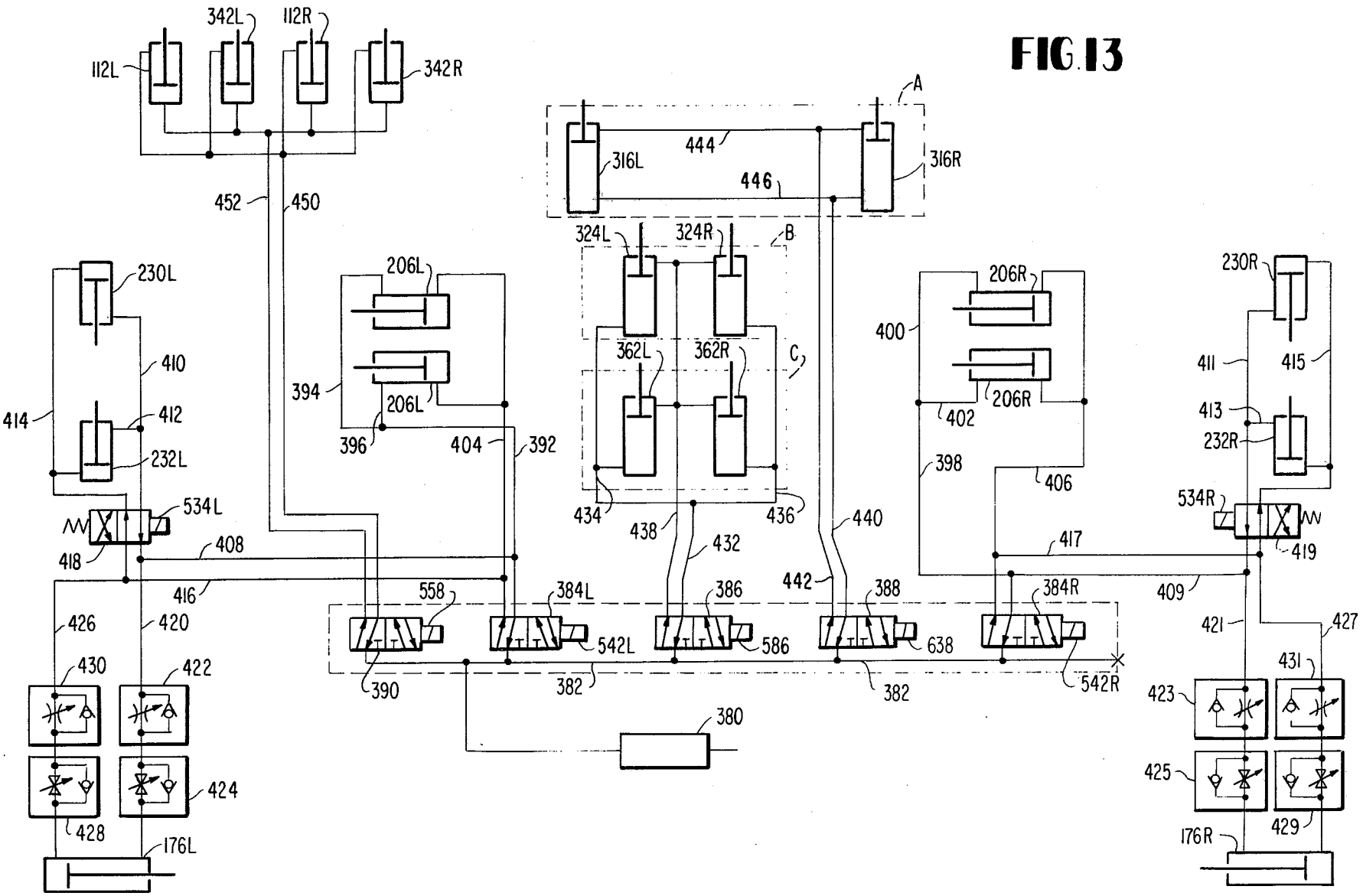
Figure 14:
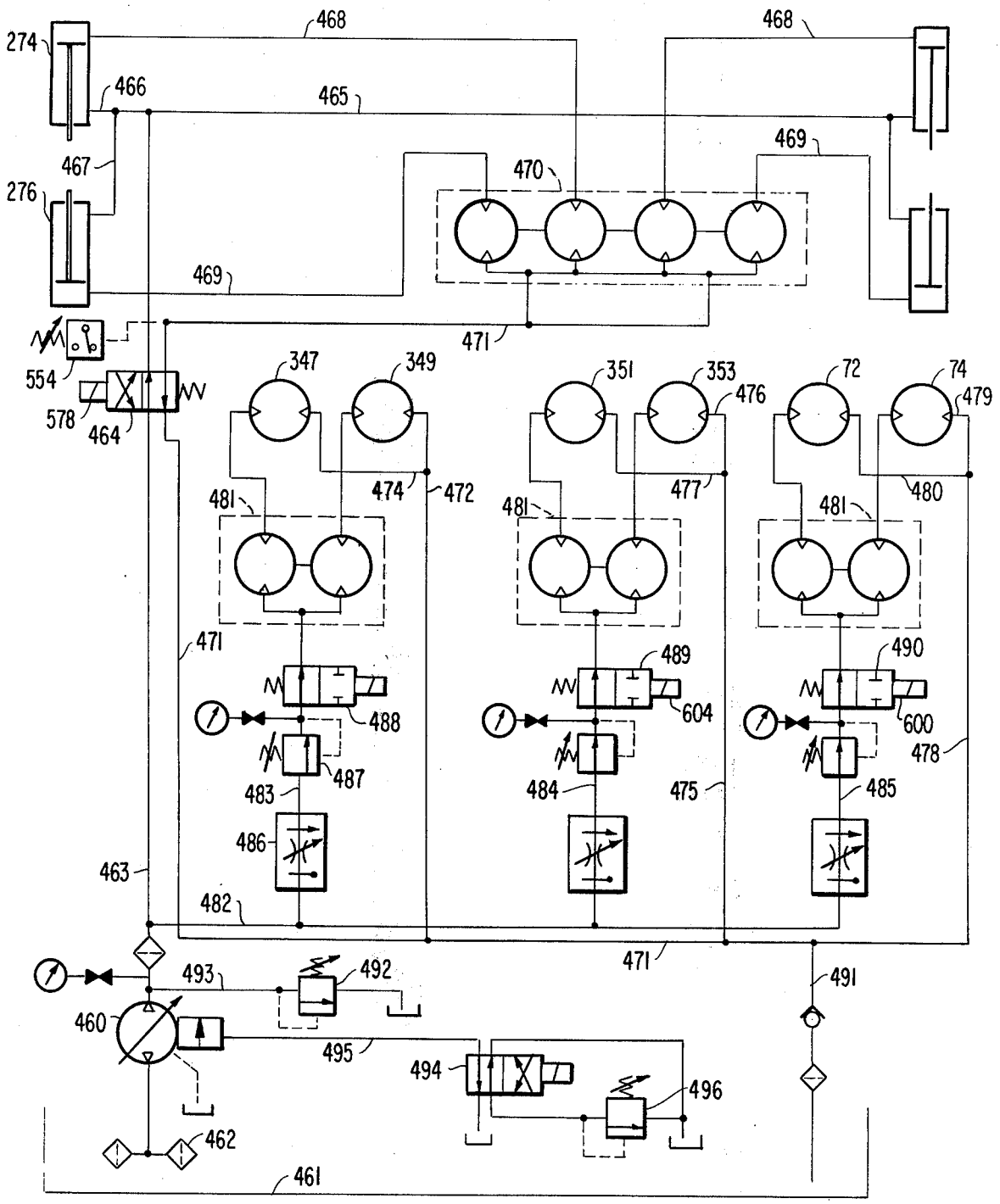
Figure 15A:
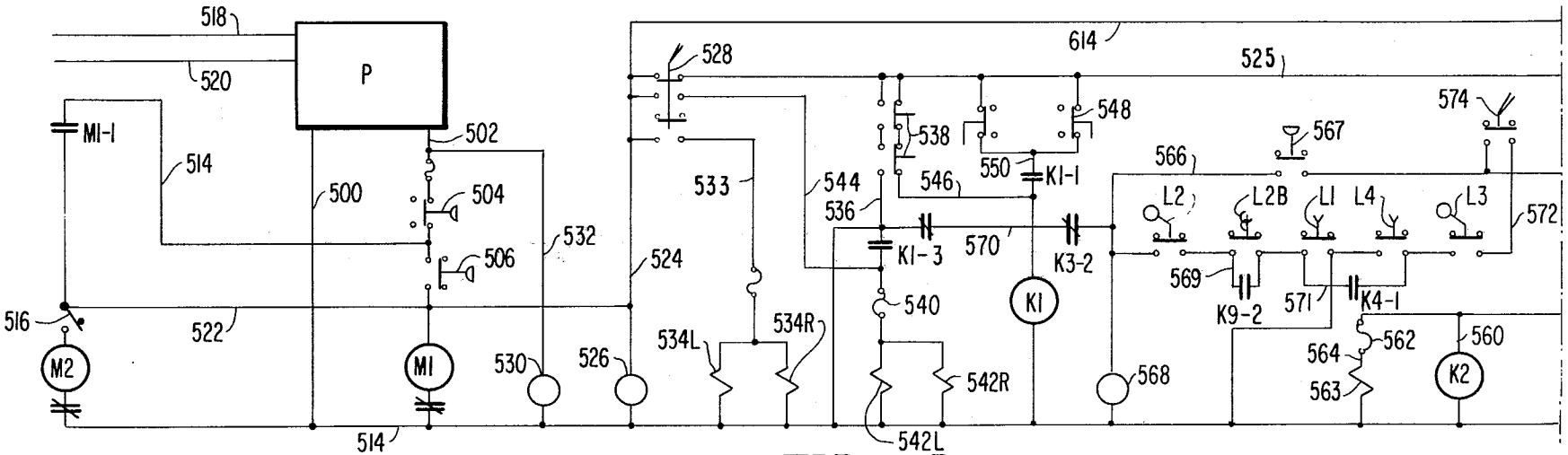
Figure 15B:
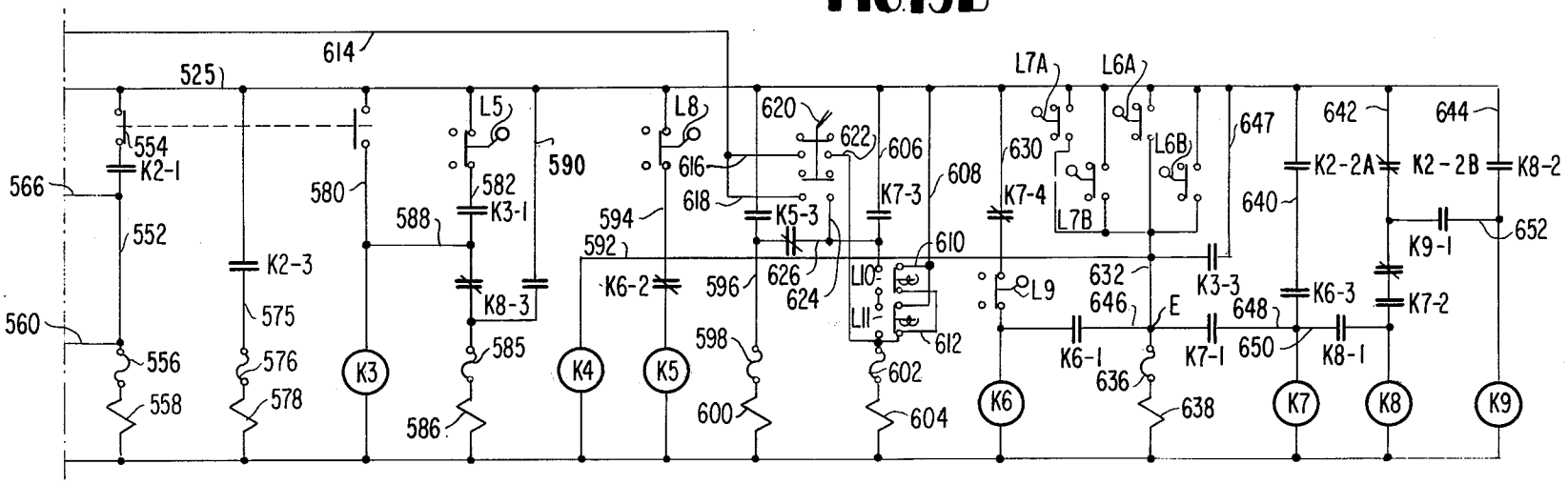

FIGS. 8, 9 and 10 are enlarged fragmentary corss-sectional views thereof taken generally about on lines 8—8, 9—9, and 10—10, respectively, in FIG. 7;

FIG. 11 is an enlarged fragmentary end elevational view of a slat and side rail lumber stop assembly;

FIG. 12 is a cross-sectional view thereof taken generally about on line 12—12 in FIG. 11;

FIG. 13 is a schematic illustration of a pneumatic circuit for use with the fabricating machine hereof;

FIG. 14 is a schematic illustration of a hydraulic circuit for use with the fabricating machine hereof;

FIGS. 15A and 15B are schematic illustrations of an electrical circuit for use with the fabricating machine hereof with the left side of FIG. 15B forming a continuation of the right side of FIG. 15A along the dashed lines; and FIGS. 16A–16D are schematic plan views illustrating the locations of the various switches, stops, and slats and rails during fabrication of a first frame and part of a succeeding frame, the press heads being indicated by the dashed lines.

Referring now to the drawings, particularly to FIGS. 1–4, there is illustrated a wooden frame fabricating machine constructed in accordance with the presènt invention and generally designated 10. Machine 10 generally includes a pair of press assemblies 12 disposed on opposite sides of the machine, slat conveyors 14, rail conveyors 16, rear slat and rail hoppers 18, and 19, respectively, forward rail hoppers 20, and output roller conveyors 22. Machine 10 generally includes a transversely extending base structure 24 on which the opposite sides of the machine are mounted, one side of machine 10 designated R being rigidly mounted to base 24 while the opposite side of machine 10 designated M is carried by base 24 for movement toward and away from the fixed machine side R. With the exception of various elements noted below, the fabricating machine 10 hereof is symmetrical about a machine centerline extending longitudinally in the direction of movement of the frames through the machine and it will be appreciated that a description of the various assemblages on one side of the machine centerline is also a description of the like assemblages of the opposite hand on the other side of the machine centerline with the exceptions noted.

Base 24 includes a pair of longitudinally spaced transversely extending channel shaped beams 26 and 28 elevated above the floor level by supports 30 and 32 disposed adjacent opposite ends of the beams. Suitable pads are interposed between supports 30 and 32 and the floor. On the fixed side R of machine 10, a base plate 34 is suitably secured to a spacer 36 carried by beams 26 and 28. The plate 34 provides support for one end of a downstream roller conveyor base frame 38 on the fixed side of the machine and which frame 38 (FIG. 1) supporting spacers 40 above the beams and which spacers 40 in turn support the side channels 42 of the roller conveyor 22. The other side of base plate 34 on the fixed side R of machine 10 mounts a plurality of upright supports 44 (FIG. 5) on which one end of the slat and rail feed conveyor assemblies 14 and 16 respectively is supported.

Figure 1:
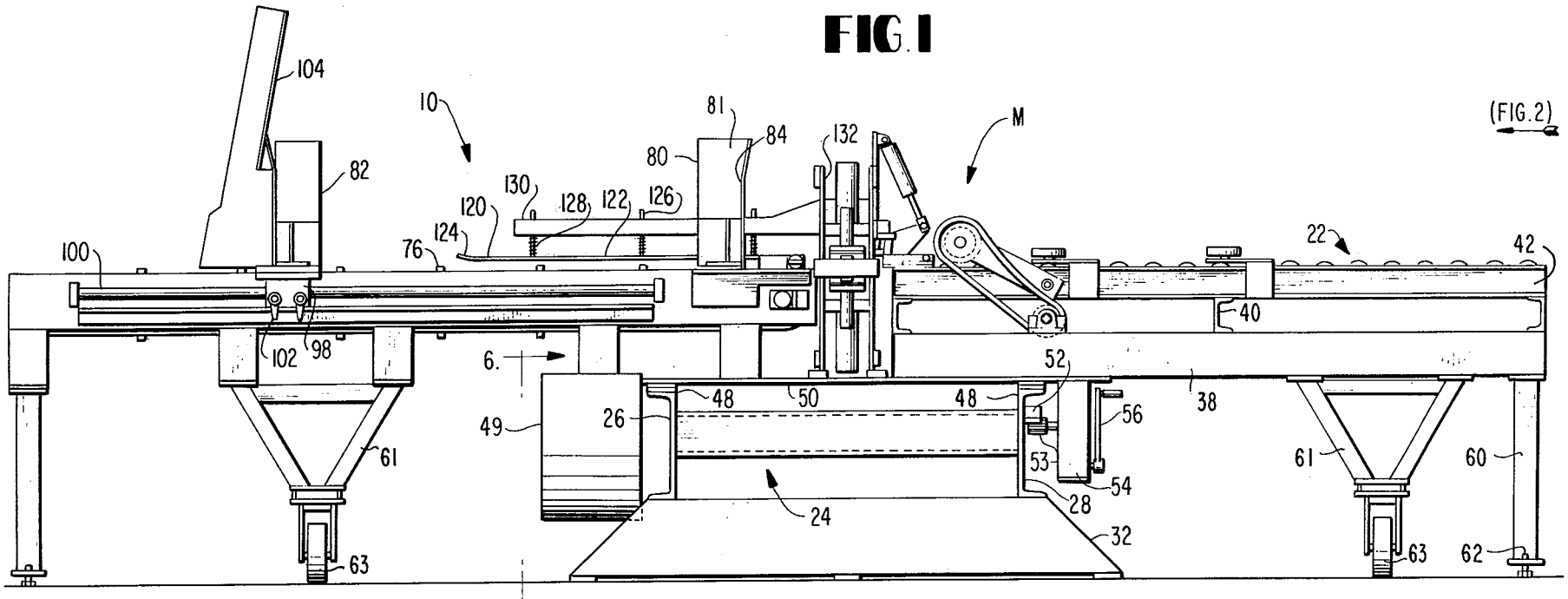
FIG. 1 is a side elevational view of a wooden frame fabricating machine constructed in accordance with the present invention.
Figure 6:
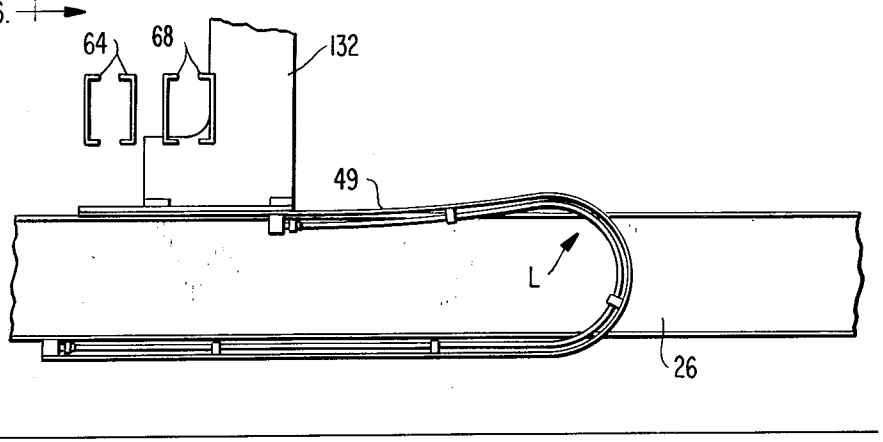
FIG. 6 is a cross-sectional view thereof taken generally about on line 6—6 in FIG. 1.

On the movable side of machine 10, there is provided a pair of guides 48 (FIGS. 1 and 2) along the upper surfaces of longitudinally spaced support beams 26 and 28. A support plate 50 (FIG. 1) is carried for slidable movement along guides 48 and suitable rollers, not shown, carried by plate 50 straddle guides 48 to enable plate 50 and the structure to be described and supported thereby for movement toward and away from the fixed side R of machine 10. A rack 52 (FIG. 2) is carried along support beam 28 and is engaged by a pinion 53 (FIG. 1). Gearing, not shown, is provided in housing 54 and rotation of a handle 56 which drives such gearing causes displacement of the movable side M of machine 10 toward and away from the fixed side R of machine 10. In FIG. 6, there is illustrated a carrier including length of sheet metal 49 reversely bent with its opposite ends secured to the movable side of machine 10 and fixed to the immovable base of the machine. As illustrated, the pneumatic, hydraulic and electrical lines, generally designated L, are suitably secured to the carrier 49 and are thus confined within its reversely bent portions and carried thereby between fixed and movable stations.

Figure 2:
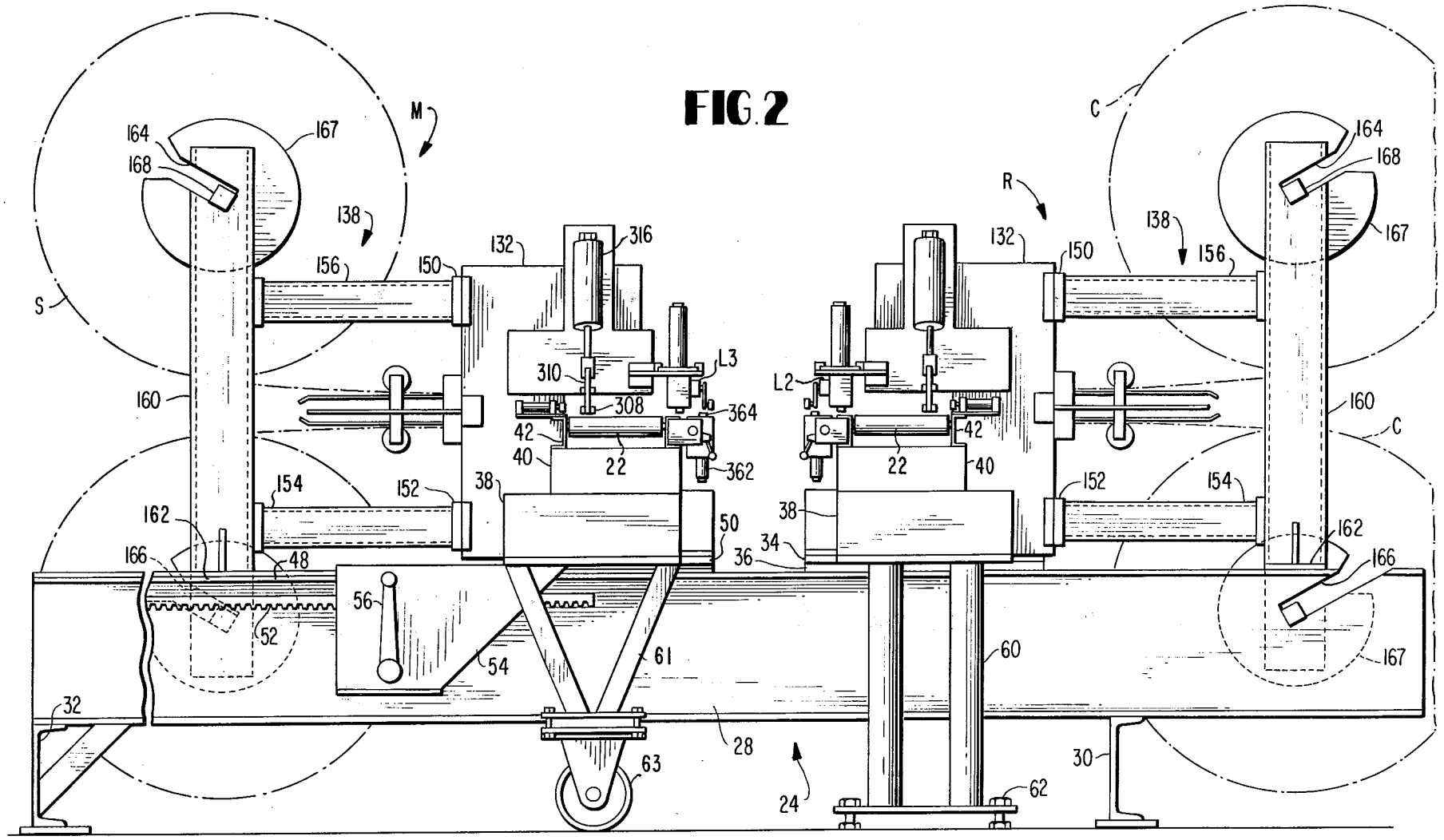
FIG. 2 is an enlarged end view thereof looking from right to left in FIG. 1.

Plate 50 provides support for one end of the roller conveyor base frame 38 on the movable side of the machine and which frame 38 in turn carries suitable supports 40 for supporting the side rail channels 42 of the downstream roller conveyor 22 on the movable side M of machine 10. As illustrated in FIG. 2, the downstream end of the roller conveyor base frame 38 on the fixed side of the machine is supported by uprights 60 secured to the floor for example by bolts 62. The downstream end of the roller conveyor base frame 38 carried by the movable side M of machine 10 is supported by legs 61, the lower ends of which mount a wheel 63. Consequently the downstream roller conveyor 22 on the movable side of the machine is carried for displacement with support plate 50 toward and away from the downstream roller conveyor 22 on the fixed side of the machine by operation of handle 56.

Figure 3:
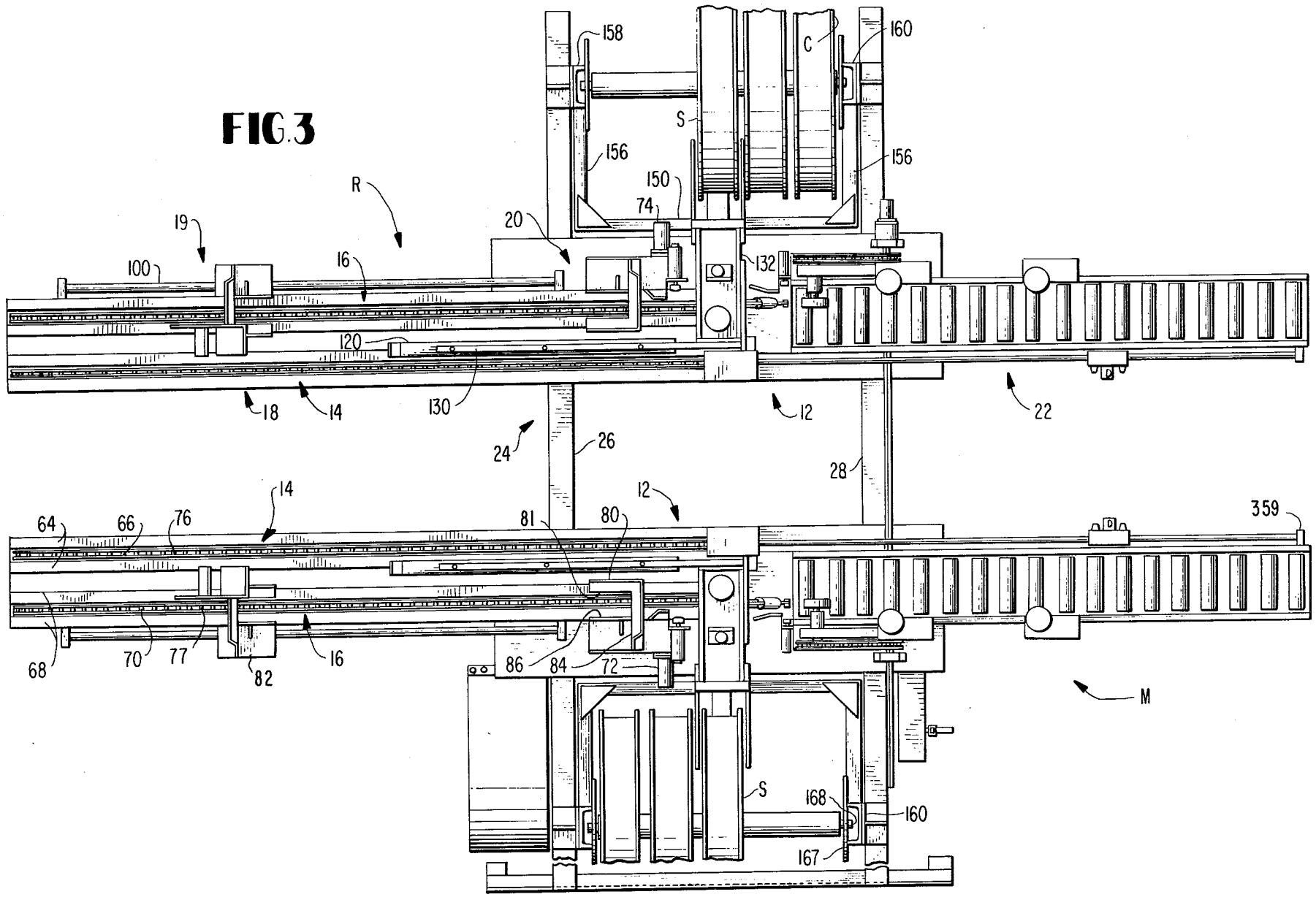
FIG. 3 is a plan view of the frame fabricating machine hereof.
Figure 4:
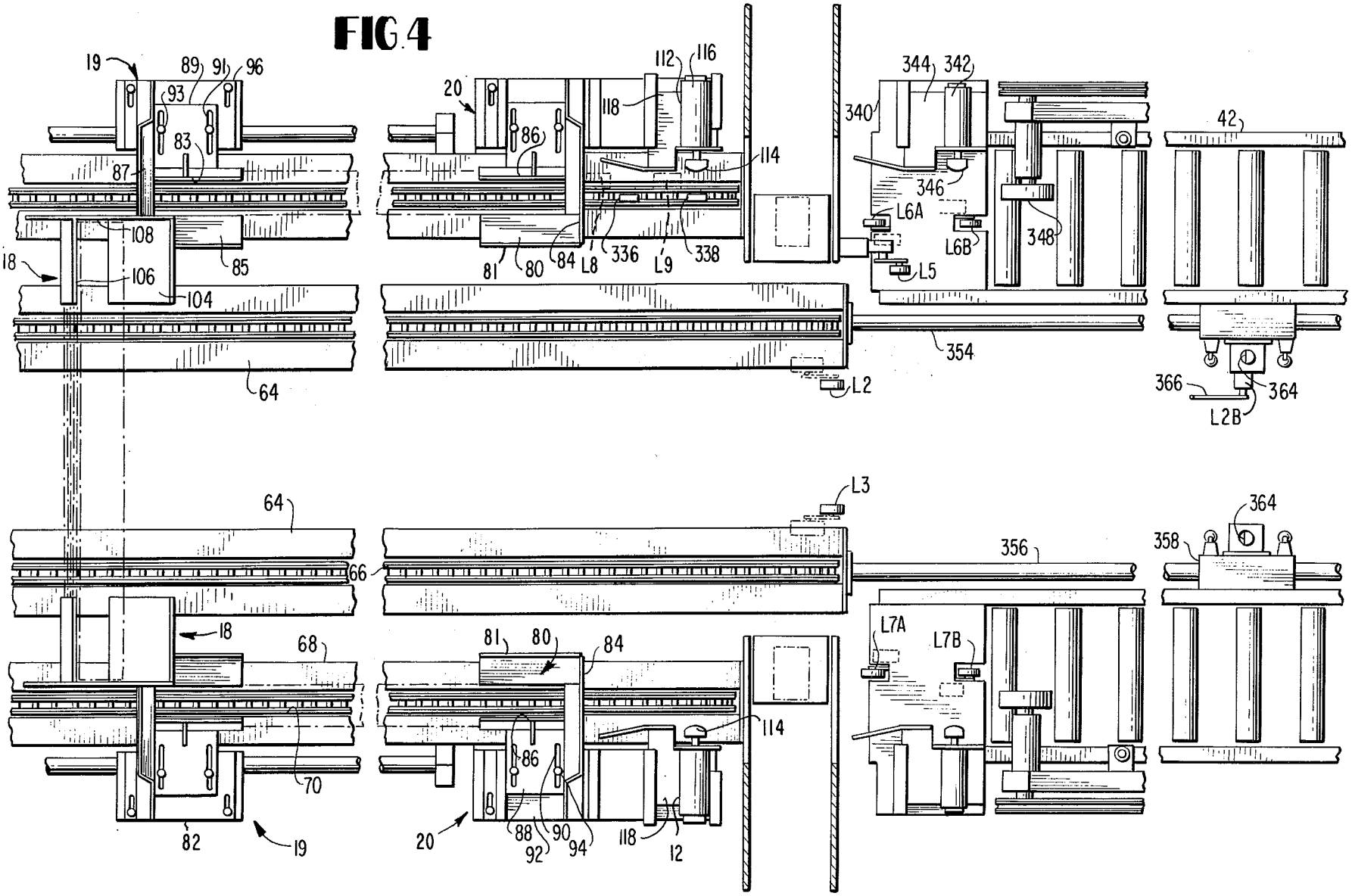
FIG. 4 is an enlarged fragmentary plan view with portions broken out for ease of illustration.

The respective support plates 34 and 50 on the fixed and movable sides of the machine also support the ends of the input slat and rail conveyor assemblies on opposite sides of the machine. It will be appreciated that the slat and rail conveyors are identical in construction with the exception that one is rigidly mounted on the fixed side of the machine while the other is mounted for movement with the movable side of the machine. Each slat conveyor frame assembly comprises a pair of generally elongated laterally spaced channel shaped beams 64 between which is carried a slat feed chain 66 (FIGS. 3 and 4). Outboard of the slat conveyor assembly 14 is a pair of elongated laterally spaced generally channel shaped beams 68 between which is carried a rail feed chain 70. Each of the chains 66 and 70 are disposed about suitable idler sprockets and are trained about drive sprockets at their forward ends. The slat and rail drive sprockets are driven independently of one another by hydraulic motors described below in conjunction with FIG. 14, the hydraulic motors 72 and 74 for the rail conveyors are, however, illustrated in FIG. 3. It will also be appreciated that suitable chain tensioning devices, not shown, are secured between respective pairs of beams 64 and 68 whereby the desired tension is maintained on the chains. Each of the slat drive chains carries a plurality of longitudinally spaced lugs 76 illustrated in FIG. 1 and which lugs 76 upstand from the chain above the upper surfaces of support beams 64. The upper surfaces of beams 64 constitute conveyor surfaces along which the slats are advanced toward the press assemblies 12 by engagement of the lugs 76 behind the slats received on the conveyor surfaces from the slat hoppers 18 as will be clear from the ensuing description. Similarly upstanding lugs 77 are longitudinally spaced along the rail drive chain and upstand from chain 70 above the upper surfaces of support beams 68. The upper surfaces of beams 68 constitute conveyor surfaces along which the rails are advanced toward the press assemblies 12 by the engagement of lugs 77 against the rear ends of the rails received on such conveyor surface from the rail hoppers 18 and 20.

Hoppers for containing and feeding wooden rails and slats for forming the frame undergoing fabrication are carried on the input side of the machine. Particularly, each side of the machine carries a forward hopper assembly 80 and a rear hopper assembly 82 for retaining the opposite ends of the side rails and for consequtively feeding rails onto the feed surface of beams 68 for engagement by lugs 77 of the slat drive chain. Particularly, each forward hopper assembly 80 generally includes right angular related upstanding side and end guides 81 and 84. Guides 81 and 84 incline inwardly and forwardly, respectively, such that the forward ends of the rails can be readily disposed within forward hopper assembly 80. Along the outer side of the forward hopper assembly there is provided an upstanding guide 86 having a laterally outwardly directed plate 88. Slots 90 are formed in plate 88 and the latter is carried by a base plate 92 which is provided with suitable gibs and cap screws 94 within slots 90 whereby the outer upright plate 86 is slidably adjustable toward and away from the opposite upright 81 along base plate 92. In this manner, the width of the forward hopper assemblies can be adjusted to accommodate various widths of side rails. Plate 92 is suitably secured to the outer beam 68 of the rail conveyor assembly. The hopper assembly 80 on the fixed side of the machine is thus fixed therewith while the hopper assembly 80 on the movable side of the machine is movable therewith toward and away from the fixed side of the machine. The lower end of the forward upright 84 is spaced above the conveyor surface a distance at least sufficient to permit advancement toward the presses of a rail between such lower edge and the conveyor surface formed by beams 68. A vertical plate, not shown, is carried by upright 84 in a vertically adjusted position such that the height of the opening between the upright 84 and the conveyor surface can be adjusted to accommodate the different thickness of the wooden members comprising the rails of the frame undergoing fabrication.

Referring now to the rear rail hopper assemblies 19, each such hopper assembly includes transversely opposed upright plates 83 and 85 (FIG. 4) with plate 85 extending above plate 83 and inclining inwardly. A back upstanding plate 87 is provided whereby a slot is formed by plate 83, 85, and 87 for receiving the rearmost ends of the wooden rails. The inclined surfaces of upright plates 87 and 85 of the forward and rear hopper assemblies 20 and 19 respectively, enable placement of the wooden rails in the hopper from outside of machine 10 in stacked relation one above the other in each set of side rail hoppers. The upstanding plate 83 carries a base 89 which has slots 91 for receiving screws 93 threadable into a base plate 96 whereby the upright plate 83 is laterally adjustable toward and away from upright 85 to accommodate rails of different widths. The lower edge of upright plate 83 is spaced above the conveyor surface to permit the upstanding lugs 77 of the rail conveyor chain to pass below it and engage the rear end edge of the lowermost rail resting on the conveyor surface formed by beams 68.

The base plate 96 of each rear rail and slat hopper assembly 18 and 19 respectively is provided with a depending clamp 98 (FIG. 1) engageable about a longitudinally extending guide shaft 100 secured along the outside of the outermost beam 64. Each rear hopper assembly is slidable along the conveyor surface and along rod 100. Clamp 98 is provided to releasably secure each rear hopper assembly in a longitudinally adjusted position along the conveyor surface by securement of clamp 98 to rod 100 by rotation of operating handles 102. Consequently, the forward and rear hopper assemblies cooperate to receive rails of equal lengths but which rails may vary in length depending upon the length of the frame undergoing fabrication.

The previously described hopper assembly also includes a part of the slat hopper 18 which is longitudinally movable with the rail hopper assembly 19. The slat hopper includes a pair of longitudinally spaced substantially upright guide plates 104 and 106 and a vertically extending side plate 108 forming a slot for receiving one end of a slat disposed transversely of the machine. The upright 104 is inclined forwardly toward the press while the upright plate 106 is initially inclined forwardly and then extends vertically and to a lesser height than upright 104 whereby slats can be fed into the slat hopper from the rear end of the machine from between the rail and slat conveyors and superposed one over the other. The lower edge of upright 104 is spaced above the conveyor surface and carries a vertically adjustable plate for varying the spacing between the plate and the conveyor surface whereby slats of various thicknesses can be engaged by lugs 76 and displaced from beneath the hopper along the conveyor surface formed by beams 64 toward the presses. The upright plate 106 is also adjustable longitudinally toward and away from upright plate 104 whereby slats of various widths can be accommodated in the slat hopper depending upon the width of the slats required for the frame undergoing fabrication.

As best illustrated in FIG. 4, a pair of clamps 112 are mounted on the opposite sides of the machine on the input side of presses 12 and include a clamping head 114 and a hydraulic cylinder 116 for extending and retracting the clamping head 114. The clamp 112 is mounted on a guide plate 118 secured in adjustable transverse position on base plate 92 which also carries the forward hopper assembly 20. Clamp head 114 is located at an elevation to engage the outer side edge of the rails to press the latter against the slats therebetween such that the ends of the slats butt the inner edges of the side rails when such joints are located between the opposed press heads as described hereinafter.

As best illustrated in FIGS. 1 and 3, a pressure bar 120 is superposed over each slat conveyor surface on the input side of the press to maintain the slats in slidable bearing engagement along the slat conveyor surface formed by beams 64. Each of the pressure bars 120 includes an elongated plae 122 having an upwardly flared end 124 to facilitate reception of the slat between it and the slat conveyor surface as the slot is advanced along such slat conveyor surface. Plate 122 is supported by a plurality of rods 126 which are biased to move with plate 122 by compression spring 128. The plate 122, rods 126 and compression spring 128 are carried by a support arm 130 secured at one end to the inside end edges of a pair of generally longitudinally spaced C-shaped frames 132 which form the basic support for each of press assemblies 12.

A press assembly of the type used herein is best illustrated in FIG. 7–10. It will be appreciated that a description of one of the press assemblies will suffice as a discussion of both press assemblies since like press assemblies are mounted on the fixed and movable sides of the machine. As illustrated, each press assembly is located between the input slat and rail conveyors 14 and 16 and the output roller conveyors 22 and comprises a pair of longitudinally spaced C-shaped frames 132, which carry upper and lower press platens 134 and 136, respectively (FIG. 7); frame assemblies generally indicated 138 (FIG. 2) for carrying coils of connector plate stock; a feed assembly generally designated 140 (FIG. 7); and a stock cutting assembly generally designated 142. Each pair of C-frames 132 is mounted on a corresponding underlying support plate, i.e. plates 34 or 50. Thus, the C-frame and press assembly carried thereby on the fixed side of the machine is rigidly secured to plate 34 fixed to support beams 26 and 28 while the C-frame and press carried thereby on the movable side M of machine 10 is secured to plate 50 which as will be recalled is movable with the input and output conveyors relative to support beams 26 and 28 toward and away from the opposite fixed side of the machine. As illustrated in FIGS. 2 and 3, the coil frames 138 include upper and lower longitudinally extending beams 150 and 152 secured to the outer edges of the C-shaped frame members 132. Each beam 150 and 152 carries a pair of longitudinally spaced laterally outwardly projecting supports 154 and 156 respectively at its opposite ends, such supports being joined at their distal ends by upright beams 158 and 160, (see FIG. 3). The lower ends of upright beams 160 carry gusset plates 162 which bear on beams 26 and 28, respectively. The plate 162 on the fixed side R of the machine is rigidly secured to beams 26 and 28 while the plate 162 on the movable side M of machine 10 bears on guide surface 48 for lateral movement with the C-frame toward and away from the fixed side of the machine. Each upright 160 is provided with downwardly inclined slots 164 and 166 respectively adjacent their upper and lower ends. Similarly slotted guide plates 167 are provided along the inside faces of each of beams 160 with such slots in respective registry with the slots 164 and 166. Axles 168 are received in the slots 164 and carry upper and lower coils or reels C of the connector plate stock S. Each coil comprises a hib carrying a pair of circular axially spaced radially extending flanges and about which hub the stock S is coiled. Each connector plate stock S comprises an elongated strip of sheet metal having a plurality of elongated nail-like teeth struck therefrom, preferably in longitudinally extending rows, to project to one side of the strip, the strip being coiled with the teeth projecting radially outwardly. Such connector plate stock and the coils carrying such stock may be of the type described and illustrated in companion applications Ser. Nos. 462,444, filed Apr. 19, 1974, now U.S. Pat. No. 3,895,706, dated July 22, 1975 and 431,046, filed Jan. 7, 1974, now U.S. Pat. No. 3,910,512, dated Oct. 7, 1975 of common assignee herewith, the disclosures of which applications are included herein by reference as though fully set forth herein.

Referring particularly to FIG. 7, the coiled connector stock S is fed from the upper and lower reels by feed assembly 140 and toward the press platens 134 and 136. The feed assembly 140 is carried by a guide plate 170 which is secured to the C-frame plates 132 directly by screws, not shown. Feed assembly 140 is also supported by slide rods, not shown, carried along the outer sides of the C-frame plates 132. Such rods extend through bearings on the outer sides of the C-frame plates 132 enabling feed assembly 140 to be unscrewed from C-frame plates 132 and retracted along the bearings while remaining supported by the rods whereby total disconnection of the feed assembly from the press assembly, for example to obtain access to its various parts and for maintenance, is not necessary. Guide 170 as best illustrated in FIG. 10, is slotted along its upper and lower sides to receive the flanges of upper and lower channel shaped stock guide tables 172 and 174, respectively. Stock guide tables 172 and 174 extend toward the peripheries of the upper and lower stock reels respectively and straddle upper and lower sides of a stock feed cylinder 176 which is threadedly connected at its forward end to guide 170. Feed cylinder 176 carries a shaft 78 which is connected at its forward end to a stock clamp and feed assembly generally indicated 180. Referring particularly to FIG. 7, a pair of brackets 182 are mounted on opposite sides of stock guide tables 172 and 174 and are slotted at their opposite ends at 184. Upper and lower entrance guide rollers 186 and 188 are disposed between the respective upper and lower ends of brackets 182 and pins carrying rollers 186 and 188 are received in slots 184. Springs 190 are coupled between the upper and lower pins on opposite sides of the cylinder 176 to bias the rollers toward each other and their respective tables to maintain the stock from the upper and lower reels thereof between the rollers and the tables as it is fed toward the press assembly.

Referring to FIG. 10, channel shaped guide plates 192 and 194 are connected to the upper and lower sides of guide 170 whereby the guide plates 192 and 194 form upper and lower passages 196 and 198, respectively, for receiving the stock en route to the press platens. Each channel shaped stock guide plate 192 and 194 has a transversely extending bore 200 through one side thereof and through which is received a pilot pin 202. The outer end of each pilot pin 202 is carried by a cylinder plate 204 which, in turn, is mounted on the piston shaft of a pilot cylinder 206. Each pilot cylinder 206 is secured to the respective stock guide by cylinder bracket 208. Accordingly, it will be appreciated that extension and retraction of the pistons within the pilot cylinders 206 cause the pilot pins 202 to retract and extend into the respective guide passages 196 and 198 for purposes which will be described in the ensuing description.

Referring particularly to FIGS. 7 and 9, the feed clamp assembly 180 includes a slide block 210 mounted on a pair of slide rods 212 for sliding movement between the illustrated forward position (FIG. 7) and a position substantially adjacent the forward face of guide plate 170. The rods 212 are secured at one end to guide 170. Slide block 210 is recessed along its upper and lower sides as indicated at 214 and 216, respectively, (FIG. 9) and upper and lower jaws 218 and 220 are secured to slide block 210 and within the respective recesses 214 and 216. The upper and lower surfaces of jaws 218 and 220, respectively, are grooved in a longitudinal direction to form transversely spaced tines 222 and 224, respectively. That is to say, such surfaces form a longitudinally extending comb-like surface which receives the teeth of the connector stock as it is fed forwardly to the press platens. In this manner, the connector stock is maintained in a predetermined lateral location. Mounted on opposite sides of slide block 210 are upper and lower cylinder brackets 226 and 228, respectively. Each bracket is counterbored to threadedly receive the ends of upper and lower clamping cylinders 230 and 232, respectively. Cylinders 230 and 232 mount grippers 234 and 236, respectively, on the ends of their respective piston shafts. It will be appreciated that extension of the grippers toward the opposite jaws clamps the connector stock between the tines of the jaws and the grippers. As illustrated in FIG. 7, the entrance ends of jaws 218 and 220 are flared to facilitate entry of the stock through the clamp assembly 180. The forward end of slide block 210 carries an alignment block 244 (FIG. 7) which is stepped at its forward face for alignment between the spaced upper and lower cut-off blade mounting blocks 246 and 248 respectively which form part of the press assembly.

Referring to FIGS. 7 and 8, blocks 246 and 248 are mounted between C frame plates 132 and mount upper and lower plates 250 and 252, respectively which in turn mount the fixed upper and lower cutting blades 254 and 256. Plates 250 and 252 are suitably secured at opposite sides to the under and upper sides of the upper and lower mounting blocks 246 and 248, respectively and are spaced therefrom to define respective upper and lower stock passages 258 and 260. Plates 250 and 252 as well as mounting blocks 246 and 248 are enlarged adjacent the entrance apertures to passages 258 and 260 to facilitate entry of the stock. Cutting blades 254 and 256 are each provided with a plurality of transversely spaced tines indicated 261 defining grooves 262 therebetween for receiving the teeth of the stock. That is to say, the blade 254 carries upwardly directed tines 261 between which and in grooves 262 the downwardly directed teeth of the stock passing through passage 258 are received. The base portion of the stock passes between the upper edges of tines 261 and the lower face of block 246. Likewise, the fixed lower blade 256 carries the downwardly directed tines 261 between which and in grooves 262 the upwardly directed teeth of the stock passing through passage 260 are received. The base portion of the stock passes between the lower edges of tines 261 and the upper face of block 248. The forward edges of tines 261 on each of the fixed lower and upper blades 254 and 256 form cutting edges whereby discrete upper and lower connector plates may be sheared from the stock by the press platens in a manner to be discussed. That is, the edges of the comb-like tines 161 on the fixed cutting blades form fixed reaction surfaces for cooperation with movable cutting blades whereby connector plates are cut from the stock as the press platens 134 and 136 move toward one another.

Referring to FIG. 7, upper and lower press cylinder support plates 270 and 272 extend between the C-frame plates 132 and mount upper and lower press cylinders 274 and 276, respectively. Cylinders 274, and 276 are threaded into bearing plates and the piston shafts are respectively connected to the upper and lower press platens 134 and 136. Platens 134 and 136 carry respective cutting blades 278 and 280 for cooperation with the fixed upper and lower blades 254 and 256 to shear the connector stock S to selected lengths to form connector plates for joining the butted wooden members of the frame undergoing fabrication. It will be appreciated that simultaneous extension of the pistons of press cylinders 274 and 276 moves platens 134 and 136 toward one another whereby the ends of the connector stock are cut by cooperation of the moving and fixed blades with the cut connector plates being carried by the platens for embedding the teeth thereof into the opposite sides of the frame parts located between the pressheads in a manner to be described.

For maintaining accurate plate location after the connector plates have been cut from the strips, the cutting blades 278 and 280 carried by the upper and lower press platens each have a dovetailed groove, not shown, formed along their cutting edges in opposition to the corresponding fixed blades. The fixed blades 254 and 256 each carry an outwardly projecting dovetail-shaped tongue 284 along their cutting edges for registration with the corresponding dovetailed groove in the movable cutting blades. Accordingly, when the press platens move toward one another, the grooves and tongues cooperate to cut a dovetail-shaped groove along the rear edge of the connector plate cut from the stock. Upon continued movement of the platens toward one another, the plates ae constrained from lateral movement by engagement of the dovetailed grooves along the corresponding tongues carried by the fixed blades. The plates are thus held by the dovetailed projection until the shearing action is complete and until just prior to initial penetration of the teeth into the joint. This ensures that each plate is not displaced from its intended location in the joint after being cut prior to full embedment of its teeth into the wooden members of the joint.

Referring now to FIGS. 11 and 12, there is provided on the forwardmost C-frame plate 132 of each press assembly an inverted generally T-shaped plate 300 which supports a rail stop assembly generally designated 302. The rail stop assembly includes a yoke 304 fixed to the lower forward face of support bracket 300 and which yoke 304 pivotally carries one end of an arm 306, the opposite end of which carries a side rail stop 308. A pivot plate or bellcrank 310 is also pivotally secured to yoke 304 and to rail stop 308. The end of crank 310 opposite from its pivotal connection with rail stop 308 is pivotally connected to a clevis 312 suitably secured to the end of a piston 314 carried by a rail stop cylinder 316. Cylinder 316 is pivotally secured at its opposite end as at 318 to pivot bracket 320. It will be appreciated that extension of piston 314 pivots crank 310 and pivot arm 306 in a generally clockwise direction as illustrated in FIG. 12 whereby stop 308 can be extended into engagement against the forward end of a side rail. Retraction of piston 314 pivots crank 310 and arm 306 counterclockwise as illustrated in FIG. 12 whereby rail stop 308 is displaced forwardly along an arcuate path and into a position spaced above the side rail as the rail advances along the conveyor in a manner to be described. For convenient reference hereinafter, the rail stops are denoted stops A.

Referring particularly to FIG. 11, the support plate 300 also carries a slat stop support plate 322. Plate 322 also extends between the C-shaped frames 132 and is suitably secured thereto. A cylinder 324 upstands from a guide plate 326 carried by support plate 322 between a pair of gibs 328, the gibs carrying the guide plate 326 for adjustment in a longitudinal direction. The piston of cylinder 324 carries a stop 330 and it will be apparent that extension of the piston in cylinder 324 extends the stop 330 into the path of movement of a slat being advanced along the slat conveyor surface. For convenient reference hereinafter, the slat stops are denoted stops B. Also as illustrated in FIG. 11, a microswitch having a switch actuating arm 332 engageable by the slat is carried by the support plate 322. For convenience hereinafter, the switches carried by the slat stop supports are called L2 and L3 on opposite sides of the conveyor, respectively. Also carried by support plate 300 is a microswitch having a depending actuating arm 334, the microswitch being called L6A for convenient reference hereinafter. The corresponding microswitch on the opposite side of the machine is labelled L7A. Referring to FIG. 4, other switch locations are illustrated. For example, microswitches L8 and L9 on the fixed side of the machine having actuating rollers 336 and 338 are illustrated.

As illustrated in FIG. 4, a support plate 340 is carried by the roller conveyor frames 42 on the output side of the presses and on each of the fixed and movable sides of the machine 10. Support plate 340 mounts a clamp cylinder 342 on a guide plate 344 transversely adjustably mounted by gibs, not shown. The clamp cylinder 342 carries a clamping head 346 for engaging the outer edge of the side of a rail.

Downstream of plate 340 and above the roller conveyor, there is provided a powered roller 348. Roller 348 is driven through a suitable sprocket and chain arrangement by a hydraulic motor schematically illustrated at 347 and 349 in FIG. 14. The rollers 348 overlie the roller conveyors 22 on opposite sides of the machine and engage the upper surface of the rails as the partially completed frame is advanced through the press assembly to carry the frame forwardly.

Figure 5:
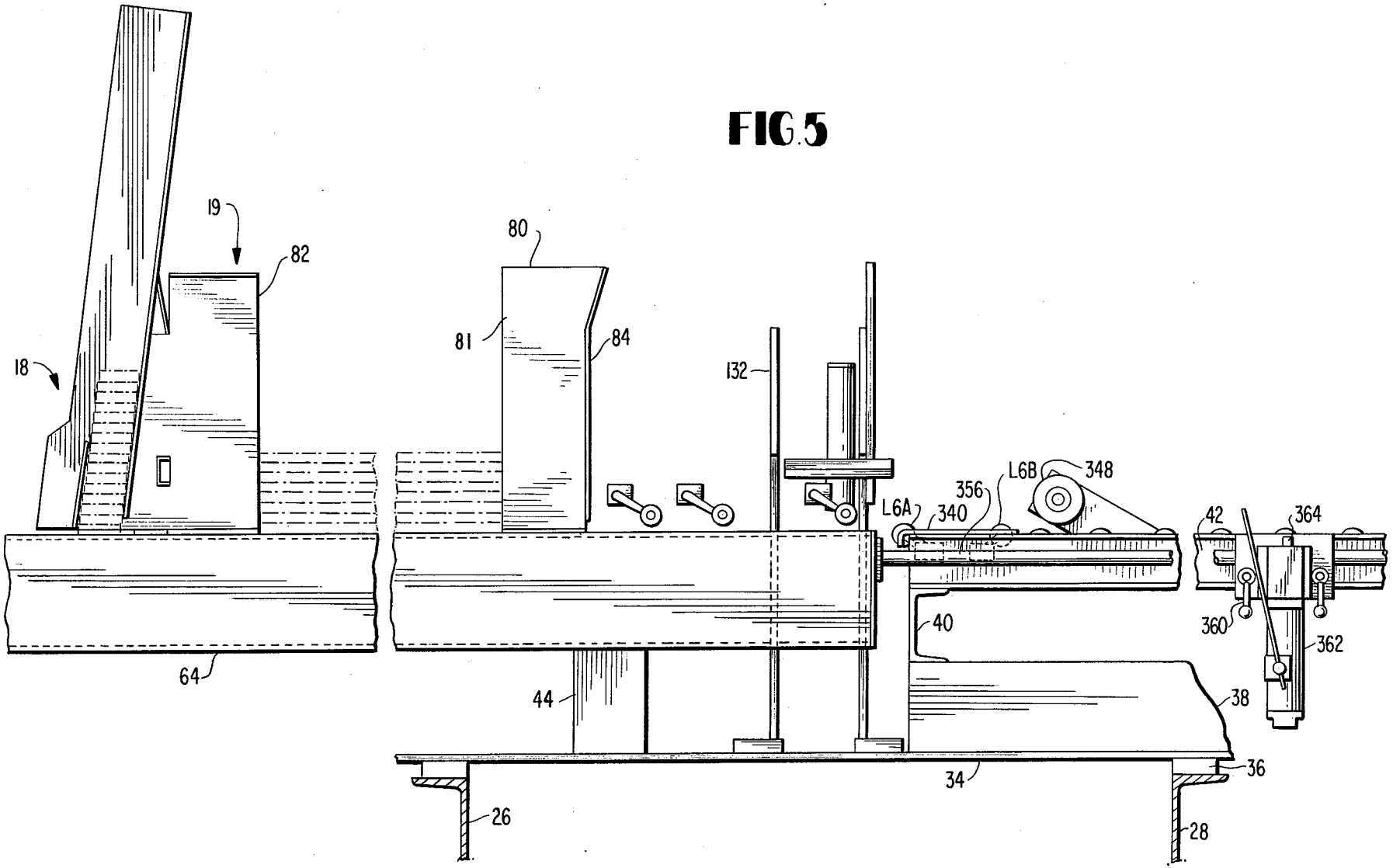
FIG. 5 is a fragmentary enlarged side elevational view of the machine hereof with portions broken out for ease of illustration.

Referring now particularly to FIGS. 3, 4 and 5, guide shafts 354 and 356 extend longitudinally forwardly from the slat conveyor support beams 64 for securement at their opposite ends to brackets 359 (See FIG. 3) secured adjacent the end of the conveyor frame. On each guide shaft 354 and 356, there is provided a clamp 358 slidable therealong and releasably locked in selected adjustable longitudinal positions along the corresponding shaft by a locking device including handle 360. Each clamp 358 carries a cylinder 362, the piston of which carries a stop 364. Extension of the piston from the cylinder moves stop 364 into the path of movement of the slats forming part of a partially completed frame. The stops 364 for convenience of description hereinafter are denoted stops C. Alongside and attached to one of the cylinders 362 is a microswitch L2B having a switch actuating arm 366. The arm extends upwardly and into the path of movement of the slats forming the partially completed frame and actuate the microswitch upon engagement of a slat against stops C.

Referring now to FIG. 13, there is illustrated a schematic diagram of a pneumatic circuit for the feed, stop and clamp assemblies. The pneumatic circuitry is identical for each press assembly including the clamping and pilot cylinders as well as the A, B and C lumber stops and clamps on opposite sides of the machine centerline. As illustrated, there is provided an air source 380 connected in parallel via a conduit 382 with five four-way five-port two-position solenoid-actuated spring-returned valves 384L, 386, 388, 384R, and 390 with associated solenoids 542L, 586, 638, 542R and 558 respectively. For brevity of description, the left and right-hand press assemblies including the stop clamps, pilot pins and feed cylinders associated therewith are identified with reference numerals having letter suffixes L and R, respectively. Valves 384L and 384R serve to provide air to the left and right pilot, stock clamp, and feed cylinders 206L, 206R, 230L, 232L, 230R, 232R; and 176L, 176R on opposite sides of the machine. Valve 386 provides air to the B and C slat stops 324L, 324R; and 362L, 362R, respectively. Valve 388 provides air to the stops A, i.e. the left and right side rail stop cylinders 316L and 316R respectively, and valve 390 provides air to the left and right lumber clamp cylinders 112L, 342L; and 112R, 342R, respectively. As illustrated, valves 384L and 384R are spring biased into the illustrated positions wherein air is delivered through valve 384L to pilot cylinders 206L via conduits 292, 394 and 396 and delivered through valve 384R to pilot cylinders 206R via conduits 398, 400 and 402 to normally maintain the pilot cylinders in retracted positions with the pilot pins extended. Conduit 404 connects at its opposite ends with the pilot cylinders 206L and valve 384L while conduit 406 connects at its opposite ends with pilot cylinders 206R and valve 384R. Valve 384L also communicates air via lines 408, 410 and 412 to the stock clamp cylinders 230L and 232L to maintain the latter in normally retracted positions. Line 414 connects the opposite ends of stock clamp cylinders 230L and 232L with a line 416 in communication with line 404. Conduits 414 and 410 flow air through a four-way two-position solenoid-actuated spring return valve 418 for purposes described hereinafter. Air is also provided stock feed cylinder 176L to maintain it in a retracted position via a conduit 420 connected to line 408 and passing through a flow control valve 422 and a time delay valve 424. The opposite end of cylinder 176L is connected to conduit 416 via a line 426 through a similar time delay and flow control valves 428 and 430, respectively. Valve 384R also communicates air via lines 409, 411, and 413 to the stock clamp cylinders 230R and 232R to maintain the latter in normally retracted positions. Line 415 connects the opposite ends to stock clamp cylinders 230R and 232R with a line 417 in communication with line 406. Conduits 415 and 411 flow through a four-way two-position solenoid-acutated spring return valve 419 for purposes described hereinafter. Air is also provided stock feed cylinder 176R to maintain it in a retracted position via a conduit 421 connected to line 409 and passing through a flow control valve 423 and a time delay valve 425. The opposite end of cylinder 176R is connected to conduit 417 via a line 427 through similar time delay and flow control valves 429 and 431.

Valve 386 communicates air via conduits 432, 434 and 436 to the B and C slat stop cylinders 324L, 324R, 326L and 362R to normally maintain the B and C stops extended. Conduit 428 couples the opposite ends of the cylinders 324L, 324R, 362L and 362R to valve 386. Valve 388 provides air via conduits 440 and 442 to the rail stops A, i.e. the left and right side rail stop cylinders 316L and 316R to maintain the latter normally extended. Conduits 444 and 446 couple the opposite sides of such cylinders with valve 388. Valve 390 provides air via conduits 450 to the lumber clamp cylinders 112L, 342L, 112R, and 342R, whereby the latter are maintained in a normally retracted position. Return conduit 452 couples the opposite ends of such lumber clamp cylinders to valve 390.

Upon energization of the stock feed solenoid 542L associated with valve 384L, valve 384L is shifted to provide air via conduit 404 to extend the pilot cylinders 206L whereby the associated pilot pins 202 are retracted. Air is also provided upper and lower clamping cylinders 230L and 232L, respectively via conduits 410 and 412 to extend grippers 234 and 236 whereby the upper and lower stock is clamped between the grippers and jaws 218 and 220, respectively. Air is also provided feed cylinder 176L via conduit 426, flow control valve 430 and time delay valve 428 to extend its piston whereby clamping assembly 180 and the stocks clamp and feed cylinders communicate with a reservoir via the previously described conduits 394, 392, 410, 408 and 420. The right-hand side of the machine is similarly operated. For example, upon energization of the stock feed solenoid 542R associated with valve 384R the valve 384R is shifted to provide air via conduit 406 to extend the pilot cylinders 206R whereby the pilot pins 202 are retracted. Air is also provided upper and lower clamping cylinders 230R and 232R via conduits 417 and 411 to extend the right-hand grippers 234 and 236 whereby the upper and lower stock on the right side of the machine is clamped between the grippers and jaws 218 and 220, respectively. Air is also provided feed cylinder 176R via conduit 427, flow control valve 431 and time delay valve 429 to extend its piston whereby clamping assembly 180 on the right side of the machine and the stock clamp thereto is advanced. The opposite sides of the various pilot, clamp and feed cylinders communicate with a reservoir via the previously described conduits 400, 398, 409, 411, and 421.

In the rest position, valve 386 provides air to slat stops B and C via conduits 432, 434 and 436 whereby the stops are normally maintained in an extended position. Upon energization of the slat stop solenoid 586, valve 386 shifts to provide air via conduit 438 to the opposite sides of the B and C slat stop cylinders 324L, 324R, 362L and 362R whereby stops 330 and 364 are retracted. Valve 388 is illustrated in position providing air to the side rail stops A, i.e., the side rail stop cylinders 316L and 316R via conduits 440 and 442. When solenoid 638 associated with valve 388 is energized, valve 388 shifts to provide air via conduits 446 and 444 to the opposite ends of cylinders 316L and 316R to retract the A stops.

Valve 390 normally supplies air to the lumber clamp cylinders 112L, 112R, 342L and 342R via conduit 450. Upon energization of solenoid 558 associated with valve 390, valve 390 shifts to supply air via conduit 452 to such cylinders to extend the clamp heads against the side rails and clamp the latter against the slat ends. Upon de-energization of solenoid 558, valve 390 springs returns to the illustrated position.

Referring now to FIG. 14, there is illustrated a hydraulic circuit for the left and right hand press cylinders 274 and 276 on each press assembly. A variable displacement pump 460 supplies fluid from a reservoir 461 through filters 462 via conduit 463 through a directional control valve 464 to one side of the press cylinders 274 and 276 to maintain the latter in a retracted position. Particularly, conduit 463 connects with a conduit 465 connected in parallel with the press cylinders on opposite sides of the machine via conduits 466 and 467. The opposite sides of the press cylinders are connected via conduits 468 and 469 with a flow divider 470. A pressure actuated switch 554 lies in communication with conduit 471 which lies in communication with the other side of flow divider 470. Conduit 471 communicates through valve 464 with the output conveyor motors 347 and 349 via conduits 472 and 474; with a pair of slat feed motors 351 and 353 via conduits 475, 476, and 477; and with a pair of the side rail feed motors 72 and 74 via conduits 478, 479 and 480. The opposite sides of each pair of hydraulic motors is connected to flow dividers 481. Conduit 482 connects with conduit 463 and each pair of hydraulic motors 347, 349; 351, 353; 72 and 74, via respective conduits 483, 484, and 485. Each of conduits 483, 484 and 485 contains a flow control valve 486, a pressure reducing valve 487, and a solenoid actuated shut-off valve, such valves being designated 488, 489, and 490 in conduits 483, 484 and 485, respectively. A conduit 491 communicates at opposite ends with conduit 471 and reservoir 461 through a suitable check valve and filter. A relief valve 492 is connected to supply conduit 463 via a conduit 493. A directional control valve 494 is coupled to pump 460 via conduit 495 and also to a relief valve 496 in communication with a reservoir.

In operation, hydraulic fluid is provided the upper and lower press cylinders 274 and 276, respectively by motor 460 and conduits 463, 466 and 467. Upon energization of solenoid 578 associated with valve 464, valve 464 shifts to supply fluid to the flow divider 470 and to the press cylinders 274 and 276 via lines 468 and 469 to extend the press platens carried thereby. Flow divider 470 serves to equalize the pressure of the fluid supplied the press cylinders to ensure uniform pressing action. Fluid flow returns to the reservoir 461 via lines 471 and 491. Upon completion of the pressing action, solenoid 578 is de-energized whereby valve 464 is spring returned to the illustrated position whereupon fluid again flows to the press cylinders 274 and 276 to retract the press platens and maintain them in a retracted position.

Hydraulic fluid also flows from pump 460 via line 482 to each set of output conveyor motors 347, 349, slat conveyor motors 351 and 353 and rail conveyor motors 72 and 74. Particularly, fluid flows via lines 482 and 483 to flow divider 481 to output conveyor motors 347 and 349 with the fluid returning via conduit 472, 471 and 491 whereby the fluid motors 347 and 349 run continuously. Energization of the solenoid associated with valve 488 shifts it to the left to prevent flow of hydraulic fluid to the output conveyor motors whereby the output conveyor motors are stopped. Hydraulic fluid is provided from lline 482 via line 484 to the flow dividers 481 for flow to the slat conveyor motors 351 and 353 with the fluid returning via lines 476, 477, 475 and 491 to the reservoir. Upon energization of the slat stop solenoid 604, valve 489 shifts to the left as illustrated to preclude flow of hydraulic fluid to the slat conveyor motors whereupon the slat conveyor stops. De-energization of solenoid 604 permits valve 489 to spring return to the illustrated position whereupon the motors again run continuously. Hydraulic fluid is supplied via conduits 482 and 485 to flow divider 481 and to the rail drive motors 72 and 74 with the fluid return being provided via conduits 479, 480, 478, and 491. Energization of rail conveyor stop solenoid 600 shifts valve 490 to the left as illustrated to preclude flow of hydraulic fluid to motors 72 and 74 and thereby stop the rail conveyor. De-energization of solenoid 600 enables spring return ov valve 490 to the illustrated position whereupon rail conveyor motors 72, 74 again run continuously.

Referring now to FIGS. 15A and 15B which is a schematic representation of an electrical control circuit for the fabricating machine hereof, the circuit is illustrated in a detached contact mode wherein the various relays represented by circles open and close associated contacts in a manner to be described, normally open and closed contacts being denoted by the pairs of parallel lines and the slashed pairs of parallel lines, respectively except where such notation is designated a switch. The contacts have numeral suffixes corresponding to the numeral suffixes of their actuating relay, the second numeral suffix indicating a particular contact.

117 volt 60 cycle current is provided across lines 500 and 502 by a suitable power source P and which power source also provides a power for hydraulic pump motor 460. Normally closed stop switch 504 and normally open start switch 506 are disposed in line 502 together with a hydraulic motor actuating relay M1 for closing corresponding contacts, not shown, in electrical lines coupled to the hydraulic pump motor. Contacts M1-1 are also disposed in line 514 connected the line 502 across start switch 506 and relay M1, a normally open control switch 516 and output conveyor motor relay M2 being serially coupled in line 514. Line 500 is directly connected to line 514 between relay M2 and its connection with line 502. Contacts, not shown, are disposed in electrical lines, also not shown, which are coupled to the output conveyor motors. Lines 518 and 520 connect power source P to the lines coupled to such motors. A line 522 is connected to line 514 between switch 516 and contacts M1-1, line 522 being connected to line 502 between start switch 506 and relay M1 and also to a line 524 between a start operation indicator lamp 526 and a load switch 528. Line 524 is connected to line 514 and a stop operation indicating lamp 530 is connected across the stop and start switches 504 and 506, respectively, and relay M1 by line 532. In the rest condition, the stop indicating lamp 530 is lit. Consequently, with switch 516 closed, power is supplied across lines 514 and 524 by closing start switch 506. Relay M1 is energized to close normally open contacts M1-1 thereby supplying power to the hydraulic pump motor and also to energize relay M2 which in turn closes contacts, not shown, to supply power to the output conveyor motors. The start indicating lamp 526 is also lit.

Line 533 connects to line 524 across an open pair of contacts of the load switch 528 and to line 514 across parallel connected load solenoids 534L and 534R. Connected in series across supply lines 525 and 514 by line 536 are the illustrated open pairs of contacts of platen limit switches 538, normally open contacts K1-3, a fuse 540, and stock feed solenoids 542L and 542R connected in parallel between lines 536 and 514. A line 544 connects between a pair of normally open contacts of the load switch 528 and line 536 between contacts K1-3 and fuse 540. The illustrated closed pair of contacts 538 of the platen limit switch 538 are coupled in series with a relay K1 across the power supply lines 524 514 by line 546. The normally closed pair of feed limit switches 548 ar coupled in parallel to line 524 while line 550 which includes normally open contacts K1-1 connects switches 548 to line 546 between the platen limit switches 538 and relay K1. The platen limit switches are illustrated in position with the platens intermediate their stroke and not fully retracted.

Connected in series between lines 524 and 514 by line 552 are the normally closed contacts of a pressure actuated switch 554, normally open contacts K2-1, a fuse 556 and a clamp solenoid 558. Line 560 connects relay K2 to line 552 between contacts K2-1 and fuse 556 and to supply line 514. A fuse 562 and a high pressure solenoid 563 are connected in series by line 564 which connects on one side with line 514 and on its other side to line 560. Line 566 connects with line 552 between contacts K2-1 and fuse 556 and with supply line 514, line 566 serially connecting a nail command switch 567 and a manual nailing indicator lamp 568. Line 570 is coupled to line 536 between normally open contacts K1-3 and the contacts of platen limit switches 538 and serially connects normally closed contacts K1-3 and K3-2 to line 566. Connected in series across the nail command switch 567 by line 572 are the normally open contacts of an automatic nailing mode command switch 574, and the contacts of normally open switches L2, L2B, L1, L4 and L3. Normally open contacts K9-2 in line 569 bridge the normally open contacts of switch L2B while normally open contacts K4-1 in line 571 bridge the remote contacts of switches L1 and L4. Connected in series across lines 524 and 514 by line 575 are normally open contacts K2-3, fuse 576 and a nail solenoid 578. Connected in series across lines 524 and 514 by line 580 are the normally open contacts of the paired contacts of pressure switch 554 and a relay K3. Also connected in series across supply lines 524 and 514 by line 582 are a normally closed switch L5, normally open contacts K3-1, normally closed contacts K8-3, a fuse 585 and the slat stop B and C retract solenoid 586. Line 588 connects line 582 between contacts K3-1 and K8-3 and with line 580 between the open contacts of pressure switch 554 and relay K3. Line 590 connects normally open contacts K8-3 across line 524 and line 582 between contacts K8-3 and fuse 585.

Serially connected between lines 524 and 514 by line 592 and 647 are normally open contacts K3-3 and relay K4. Serially connected between lines 524 and 514 by line 594 are normally closed switch L8, normally closed contacts K6-2 and relay K5. Also serially connected between lines 524 and 514 by line 596 are normally open contacts K5-3, fuse 598 and a rail stop solenoid 600. Normally open contacts K7-3, the normally open contacts of switches L10 and L11, fuse 602 and the slat stop solenoid 604 are connected in series by line 606 between lines 524 and 514. Line 608 connects with line 606 between fuse 602 and the contacts of switch L11 and with line 524, through bridging lines 610 and 612, respectively, which couple the like contacts of switches L10 and L11.

Line 614 connects with supply line 524 at the load switch 528 and by parallel lines 616 and 618 with the respective contacts forming the normally open pairs of contacts of a feed switch 620. Line 622 connects the other contact of one of the normally open contacts of switch 620 with line 606 between switch L11 and fuse 602 while line 624 connects the other contact of the other normally open contacts of switch 620 with a line 626. Line 626 carries normally closed contacts K5-3 and connects with line 596 between normally open contacts K5-3 and fuse 598 and also with line 606 between normally open contacts K7-3 and switch L10.

Connected in series across lines 524 and 514 by line 630 are normally closed contacts K7-4, normally closed switch L9 and relay K6. Line 632 connects normally open switches L7A, L6A, L7B, and L6B in parallel between lines 524 and 592, line 632 connecting with line 592 between contacts K3-3 and relay K4, and also serially couples fuse 636 and stop A retract solenoid 638 to line 514. Connected in series across lines 524 and 514 by line 640 are normally open contacts K2-2A and K6-3 and relay K7. Line 642 serially connects across lines 524 and 514 normally closed contacts K2-2B and K9-1, normally open contacts K7-2 and relay K8. Line 644 serially connects normally open contacts K8-2 and relay K9 across supply lines 524 and 514. Normally open contacts K6-1 are connected by line 646 between lines 630 and 632, line 646 connecting with line 630 between switch L9 and relay K6 and with line 632 between its connection with line 592 and fuse 636 at circuit point E. Normally open contacts K7-1 are connected by line 648 to line 632 at circuit point E and to line 640 between contacts K6-3 and relay K7. Normally open contacts K8-1 are connected by line 650 to line 640 between contacts K6-3 and relay K7 and to line 642 between contacts K7-2 and relay K8. Normally open contacts K9-1 are connected by line 652 to line 642 between normally closed contacts K2-2 and K9-1 and to line 644 between contacts K8-2 and relay K9.

OPERATION

To operare the machine, the normally opened control switch 516, used primarily for maintenance purposes, is closed. The start switch 506 is also closed to complete a circuit across lines 500 and 502 to energize relay M1. Energization of relay M1 closes the normally open contacts M1-1 to energize the hydraulic pump motor 460 and also to energize relay M2. Energization of relay M2 closes it sassociated normally open contacts, not shown, to provide power to the output conveyor motors 347 and 349. In this initial condition, and with the load switch 528 positioned as illustrated, power is provided across supply lines 524 and 514 and also across line 614 and 514. The platen limit switches 538 are closed across the illustrated open contacts in line 536 when the platens are retracted whereby the manual nail lamp 568 is lit through lines 570 and 566. Also, relay K6 is energized across lines 524 and 514 through closed contacts K7-3 and closed switch L9. Energization of relay K6 closes normally open contacts K6-1 to energize the stop A retract solenoid 638 via line 630, 646 and 632 through circuit point E. With the machine at rest in this condtion, the stock feed cylinders 176L and 176R are retracted, the pilot cylinders 206L and 206R are retracted leaving the pilot pins in passage 196 and 198 and the clamp cylinders 230L and 230R are retracted. At rest, all relays are de-energized with the exception of relay K6. Normally open contact K1-3 prevents energization of the nail feed solenoids 542L and 542R and the normally open nail switch 567 together with the normally open contact K2-1 prevent energization of the clamp solenoid 538 and high pressure solenoid 563. Normally open contact K2-3 prevents energization of the nail solenoid 578 while normally open contact K3-1 and the open contacts of the hydraulic pressure switch 554 prevent energization of the stops B and C retract solenoid 586. The slat conveyor stop solenoid 604 remains de-energized through the open contacts of switches L-10 and L-11 and through the open contacts of the manual feed switch 620.

To load the machine, the reels containing the coiled connector stock S are located on the axles 168 and the ends of the axles are located on the upper and lower slots 164 and 166 respectively of support brackets 160 on opposite sides of the machine. The reels are thus mounted for rotation but achieve a pendulum effect which prevents the reels from rotating of their own accord once the stock is fed to the machine. Load switch 528 is closed to close the contacts in lines 523 and 544, respectively to energize the respective nail feed solenoids 534L and 534R and load solenoids 542L and 542R. Energization of the load solenoids shifts valves 384L and 384R respectively and energization of feed solenoids 534L and 534R shifts valves 418 and 419 respectively to the left in FIG. 13 whereby air is provided cylinders 206L and 206R to extend the pistons and withdraw the pilot pins from passages 196 nd 198; provided cylinders 230L, 230R, 232L and 232R to extend the clamp heads to clamp the stock; and provided feed cylinders 176L and 176R and to advance the stock. Release of load switch 528 enables return of the valves to the illustrated positions with the stock remaining in an advanced position.

As will be recalled, when the operator closes start switch 506, the hydraulic pump 460 supplies fluid to the output conveyor motors 347, 349, the slat conveyor motors 476, and rail conveyor motors 72 and 74 whereby the output, slat and rail conveyors are operative. Closing start switch 506 also energizes relay K6 which closes contacts K6-1 to energize the stop A retract solenoid 638 to shift valve 388 (FIG. 13) to supply air to stop A cylinders 316L and 316R via line 446 thereby to retract stop A. Closing start switch 506 also opens normally closed contacts K6-2 to maintain relay K5 de-energized. As the rear ends of the rails R are engaged by lugs 77 and advanced along the rail conveyor by chain 70, switch L8 (FIGS. 16A-16D) is opened by one of the advancing rails to hold relay K5 de-energized. As the one rail advances further, it opens normally closed switch L9 which deenergizes relay K6 which, in turn, returns contacts K6-1 to their normally open position de-energizing circuit point E and the stop A rail retract solenoid 638. De-energization of solenoid 638 enables valve 388 to spring return to the illustrated position whereby air is again supplied to the stop A cylinders A cylinders via line 440 (FIG. 13) to extend stops A into the path of movement of the respective rails (FIG. 16A). When the rails engage stops A, switches L1 and L4 are closed respectively in line 572 (FIG. 15A) and the rail conveyor stalls.

With the slot stops B normally extended by air supplied via lines 432, 434 and 436 to slat stop cylinders 324L and 324R (FIG. 13), the lugs 76 of the slat conveyor engage and advance the first slat against extended stops B whereupon the slat conveyor 14 stalls, and the respective switches L2 L3 adjacent each of stops B are engaged by the slat and close (FIG. 16A). The closing of switches L2 and L3 indicates proper engagement of the slat against stops B in perpendicular relation to the rails and in nailing position between the press platens 134 anc 136.

The operator then manually closes the nail switch 567 to initiate nailing the first slat between the forward end of the first pair of rails and also close automatic nail switch 574 should be automatic nailing mode be desired. With the platen limit switch 538 closed across the contacts in line 536, and also automatic nailing switch 574 closed across the open contacts in line 572, closing nail switch 567 energizes via lines 536, 570, 566, and 522, the clamp solenoid 558, relay K2 and the high pressure solenoid 563. Energization of relay K2 closes normally open contacts K2-1 to maintain a holding circuit through line 552 for the clamp solenoid 558, relay K2 and high pressure solenoid 563. Energization of clamp solenoid 558 causes valve 390 to shift whereby air is supplied via line 452 (FIG. 13) to clamp cylinders 112L, 342L, 112R and 342R to extend the clamp heads carried thereby into engagement along the side eges of the rails to press the rails against the ends of the slat. Energization of relay K2 also closes normally open contacrs K2-3 to energize nail solenoid 578 in line 575 (FIG. 15B). Energization of nail solenoid 578 shifts valve 464 to supply hydraulic fluid via lines 463, 471, flow divider 470 and lines 468 (FIG. 14) to the upper and lower press cylinders 274 and 276, respectively, whereby the press platens 134 and 136 are displaced toward one another. Energization of the high pressure solenoid 563 causes valve to shift enabling operation of the restrictor to change the pressure in the hydraulic line to a high pressure, for example 3000 p.s.i. Energization of relay K2 also opens normally closed contacts K2-2 in line 642 and closes normally open contacts K2-2 in line 640. The opening and closing of such contacts by relay K2 has, however, no effect on the circuitry until the last slat in each frame is to be nailed as explained below. When the press platens move from their retracted positions the platen limit switches 538 close across the contacts in line 546 thereby energizing relay K1 to close contacts K1-1, which provides a holding circuit for relay K1 through the feed limit switches 538. Energization of relay K1 also opens normally closed contacts K1-3 in line 570 and closes normally open contacts K1-3 in line 536. Thus, energization of relay K1 upon initiation of the press cycle readies the nail feed circuit for operation upon retraction of the press platens in a manner set forth below.

At the end of the press stroke and after discrete connector plates have been cut from the connector plate stock and carried with the pressheads toward the rails and slat for embedment of the teeth thereof into the joints formed by the rails and slat, hydraulic pressure switch 554 is actuated and opens the contacts in line 552 (FIG. 15B) to deenergize the holding circuit for clamp solenoid 558, relay K2 and high pressure solenoid 563. De-energization of clamp solenoid 558 enables spring return of valve 390 for retraction of the lumber clamps by air supplied the lumber clamp cylinders via line 450. De-energization of relay K2 returns contacts K2-3 to their normally open position de-energizing the nail solenoid 578 in line 575 whereupon valve 464 (FIG. 14) spring returns and hydraulic fluid is supplied press cylinders 274 and 276 via lines 463, 466, 467 to retract the press platens 134 and 136. Actuation of hydraulic pressure switch 554 also monentarily closes the normally open contacts in line 580 thereby energizing relay K3 which, in turn, closes normally open contacts K3-1 in line 582 to provide a holding circuit for relay K3 through line 582, closed switch L5 and line 580. Energization of relay K3 opens normally closed contacts K3-2 (FIG. 15A) to disable the clamp and nail command circuit through lines 566 and 572 while the connector stock is fed to its nailing position.

The return of the pressheads 134 and 136 to their fully retracted position closes platen limit switches 538 across the open contacts in line 536 thereby energizing nail feed solenoids 542L and 542R through closed contacts K1-3 held closed by relay K1 which remains energized through its holding circuit including feed limit switches 548 and closed contacts K1-1. As will be recalled, energization of nail feed solenoids 542L and 542R shift valves 384L annd 384R to supply air via lines 404 and 406, respectively (FIG. 13) to extend pilot cylinders 206L and 206R thereby retracting pilot pins 202 from the respective stock feed passages; to supply air via lines 416, 414; 417, 415 to the stock clamp cylinders 230L, 232L; 230R and 232R to clamp the stock between the clamping jaws of the feed assembly; and to supply air via lines 416, 426; 417, 427 to the feed cylinders 176L and 176R thereby to advance the connector stock a predetermined distance to locate predetermined lengths thereof between the pressheads 134 and 136. At the end of the stock feed stroke, the feed limit switches 548 momentarily open to de-energize relay K1 returning contacts K1-3 in line 570 to their normally closed condition and contacts K1-3 in line 536 to their normally open position to de-energize nail feed solenoids 542L and 542R. Valves 384L and 384R spring return and air is supplied via lines 408, 410; and 409 and 411, (FIG. 13) to retract stock clamp cylinders 230L, 232L; 230R and 232R to release the stock and via lines 408, 420; 409, 421 to retract stock feed cylinders 176L and 176R respectively leaving the stock in the advanced positions. Return of valves 384L and 384R also supplies air via lines 392, 294; 398, 400 to retract pilot cylinders 206L and 206R respectively whereby pilot pins 202 engage between the teeth of the connector stock in the stock passages to slightly adjust the longitudinal position of the stock in the stock passages. This adjustment ensures that the stock is located such that the fixed and stationary cutting blades cut the stock between its transverse rows rather than through the teeth per se.

It will be recalled that relay K3 is energized by momentary actuation of pressure switch 554 at the end of the press stroke and embedment of the teeth of the plates into the adjoining rails and slat and remains energized through its holding circuit through closed switch L5 and closed contacts K3-1 in line 582. Energization of relay K3 also energizes stops B and C, retract solenoid 586 in line 582 whereupon valve 386 shifts to provide air via line 438 (FIG. 13) to retract the B and C slat stop cylinders 324L, 324R; and 362L and 362R, respectively. Thus, stops B and C are retracted during the nail feeding operation and partial advancement of the partially completed frame. Energization of relay K3 also closes normally open contacts K3-3 in line 647 to energize circuit point E and the stop A retract solenoids 638 whereupon valve 388 (FIG. 13) shifts to supply air via line 456 to retract stop A cylinders 316L and 316R. Consequently, stops A and B retract enabling the partially completed frame to be advanced past the nailing heads by the continuously running rail and slat conveyors. Closing normally open contacts K3-3 also energizes relay K4 which, in turn, closes normally open contacts K4-1 which bridge switches L1 and L4 in line 571 for reasons noted hereinafter.

As the partially completed frame advances, the side rails close normally open switches L6-A and L7-A to maintain circuit point E and the stops A retract solenoid 638 energized which hold stops A retracted. As the partially completed frame is advanced by the rail conveyor 16, the first slat momentarily opens switch L5 thereby de-energizing the holding circuit for relay K3. De-energization of relay K3 returns contacts K3-1 to their normally open position, returns contacts K3-2 to their normally closed position to enable the clamp and nail command circuit through lines 566 or 572, and returns contacts K3-3 to their normally open position. Circuit point E and relay K4, however, remain energized through the closed switches L6-A and L6-B. Consequently, stops A retract, solenoid 638 remains energized to maintain stops A in retracted positions and contacts K4-1 remain closed to bridge switches L-1 and L-4. Opening switch L-5 also de-energizes the stop B and C retract solenoid 586 enabling spring return of valve 386 and consequent extension of stops B and C after the first slat moves past stops B and C. Continued advancement of a partially completed frame causes the rails to close switches L6-B and L7-B. It will be appreciated that circuit point E is therefore energized for as long as any one of switches L6-A, L7-A, L6-B and L7-B are closed and consequently stop A retract solenoid 638 is maintained energized and stop A is held retracted until the rails clear the last of the switches L6-B and L7-B.

Continued advancement of the completed frame locates the rails under power rollers 348 and the rollers 348 and rail conveyor 16 continues to advance the partially completed frame to bring the first slat into engagement against extended stops C at which time the slat closes switch 12-B (FIG. 16B). Engagement of the partially completed frame against extended stops C prevents further advancement of the partially completed frame and causes the rail conveyor motors 72, 74 and the output roller conveyor motors 347 and 349 to stall. When the next slat engages stops B and the slat conveyor motors 476 stall, switches L2 and L3 are closed (FIG. 16B), two switches being necessary to ensure that the second slat lies in position for nailing and in proper perpendicular position relative to the rails. From a review of FIGS. 15A and 15B, it will be appreciated that, in order to automatically nail the second slat and all subsequent slats to the rails (with the exception of the first slat in each frame as described hereinafter) each of switches L2, L3, and L2-B must be closed provided contacts K4-1 remain closed across switches L1 and L4. When such switches and contacts are closed and the automatic nail switch 574 is also closed, the clamp and nail command circuit is energized through lines 552, 572, and 570 and through the platen limit switches 538 which are closed across the contacts in line 536. This initiates the clamping and nailing action particularly by energizing clamp solenoid 558 through lines 536, 570, 572 and 552 and by energizing relay K2 which closes contacts K2-3 in line 575 to energize the nail solenoid whereupon the pressheads move to cut discrete connector plates from the connector plate stock and embed the teeth thereof into the ends of the second slat and the opposed side rails. As before, at the end of the press stroke, hydraulic pressure switch 554 opens across the contacts in line 552 to de-energize clamp solenoid 558 and relay K2 which in turn de-energizes the nail solenoid, and to energize relay K3 in line 580 to disable the clamp and nail command circuit. Also, as before, movement of the press platens from their retracted positions enables the nail feed circuit by energizing relay K1 which enables energization of the nail feed solenoids 542L and 542R upon return of the platens to their fully retracted positions and the closing of platen limit switches 538. At the completion of the feed cycle, relay K1 is de-energized to disable the nail feed solenoids 542L and 542R and enable the clamp and nail command circuit with the exception of contacts K3-2 which are maintained open by relay K3 energized at the end of the press stroke of the platen. Energized relay K3 also energizes stops B and C retract solenoid 586 whereupon stops B and C retract enabling the partially completed frame with the first two slats secured to the side rails to advance. When the second slat momentarily opens switch 15 during advancement of the partially completed frame, relay K3 is de-energized to close contacts K3-2 and thereby fully enable the nail command circuit. The foregoing described sequence continues for each of the subsequent slats of the first frame except for the last slat.

In summary, as the frame is advanced and each succeeding slat engages stops B and C, switches L2, L3, and L2-B close to initiate the clamp and nail operation; completion of the pressing stroke initiates retraction of the B and C slat stops and retraction of the clamps enabling the partially completed frame to advance; and return of the press heads initiates the connector stock feed cycle, the full return of which pressheads enables subsequent energization of the nail command circuit in response to closing switches L2-B, L2 and L3 when the next slat is ready for nailing.

It will be appreciated that as the partially completed frame is advanced, the rails behind the partially completed frame are very closely spaced to the trailing ends of the rails of the partially completed frame. It is, however, desirable to enlarge the spacing between the rails of a partially completed frame and the rails of the next frame to be fabricated. When the trailing end of the rails of the partially completed frame pass switch L8 prior to nailing the last slat thereof (FIG. 16C), switch L8 (FIG. 15B) returns to its normally closed position to energize relay K5 through line 594. Energization of relay K5 closes normally open contacts K5-3 in line 596 to energize the rail conveyor stop solenoid 600 which shifts valve 490 to stop the rail conveyor. The partially completed frame, however, continues to advance under the powered roller 348 and the rail of such frame uncovers switch L9 (FIG. 16C). Switch L9 in line 630 (FIG. 15B) is thus returned to its illustrated normally closed position to energize relay K6 through line 630. Energization of relay K6 closes normally open contacts K6-1 to hold relay K6 energized through the energized circuit point E and the one or more switches L6-A, L6-B, L7-A and L7-B. Energization of relay K6 also opens normally closed contacts K6-2 to de-energize relay K5 and return contacts K5-3 in line 596 to their normally open positions and contacts K5-3 in line 626 to their normally closed position whereby rail stop solenoid 600 is de-energized enabling spring return of valve 490 and restart of rail conveyor 16. Energization of relay K6 also closes normally open contacts K6-3 in line 640 (FIG. 15B) to enable energization of relay K7 when the nailing of the final slat in the frame is commenced. When switch L2-B is closed as the next to the last slat engages stop C, and the final slat engages stops B to close switches L2 and L3, nailing is iniitated as before through lines 536, 570, 572 and 552 to energize the clamp solenoid 558. High pressure solenoid 563 and relay K2 which in turn closes contacts K2-3 to energize the nail solenoid 578. The nailing cycle and the nail feed cycle proceed as previously described.

However, energization of relay K2 at the start of the nailing cycle also closes normally open contacts K2-2 in line 640 and opens normally closed contacts K2-2 in line 643 (FIG. 15B). It will be recalled that relay K5 was initially energized through line 630 and closed switch L9 and that contacts K6-3 in line 640 are thereby held closed. Relay K7 is thus energized through line 640. Energization of relay K7 closes normally open contacts K7-1 to provide a holding circuit for relay K7 through energized circuit point E and closes normally open contacts K7-2 in line 642. Normally open contacts K7-3 in line 606 are also closed upon energization of relay K7 and energize the rail stop solenoid 600 through the normally closed contacts K5-3 in line 625 and lines 606 and 596 to again shift valve 490 (FIG. 14) to stop rail conveyor motors 72 and 74. Contacts K7-3 in line 606 close to also energize slat conveyor stop solenoid 604 through line 606 and closed switches L10 and L11 to stop the slat conveyor. Energization of relay K7 also opens contacts K7-3 in line 630 but relay K6 is held energized through circuit point E.

At the completion of the press stroke, it will be recalled that relay K2 is de-energized and this causes normally open contacts K2-2 in line 642 to return to their normally closed position thus energizing relay K8 through line 642, closed contacts K9-1 and closed contacts K7-2. Energization of relay K8 closes normally open contacts K8-1 in line 650 to hold relay K8 energized through circuit point E, closes normally open contacts K8-2 in line 644 to energize relay K9, closes normally open contacts K8-3 in line 590 to energize the stops B and C retract solenoid 586 thereby to shift valve 386 (FIG. 13) to supply air to stop B and C cylinders 324L, 324R; 362L, 362R, respectively and retract stops B and C, and also opens normally closed contacts K8-3 in line 582. The power roller 348 then advances the completed frame such that the trailing ends of the frame clear the press positions and also clear switches L10 and L11 (FIG. 16D). Switches L10 and L11 thereupon return to their closed positions across the contacts in line 608 maintaining slat stop solenoid 604 energized through line 608 and the slat conveyor stopped.

Energization of relay K9 at the completion of the press stroke for nailing the last slat opens normally closed contacts K9-1 in line 642 and closes normally open contacts K9-1 in line 652 to hold relay K9 energized through lines 642 and 644. Opening contacts K9-1 in line 642 takes the signal off relay K8 through line 642 but relay K8 remains energized by the holding circuit through closed contacts K7-1 and K8-1 and energized circuit point E.

As will be recalled, at the completion of the first half of the nailing cycle, relay K3 is energized and held through switch 15 and closed contacts K3-1. Relay K3 is also de-energized and thus returns contacts K2-2 in line 640 and 642 to their normally open and closed positions, respectively. This disables relays K7 and K8 through lines 640 and 642, respectively, but relays K7 and K8 remain energized through the holding circuit through energized circuit point E. Relay K9 remains energized through closed contacts K9-1 in line 652 and the returned closed contacts K2-2 in line 642. Thus, as the completed frame advances, relays K3, K4, K6, K7, K8 and K9 remain energized.

As the completed frame is advanced further by the powered rollers, it clears switches L6-A and L7-A but circuit point E and the relays K6, K7, K8 and K9 remain energized through closed switches L6B and L7B. As the frame continues to advance, switch L5 momentarily opens as the final slat moves past de-energizing relay K3. De-energization of relay K3 returns contacts K3-3 to their normally open position to again enable the nail command circuit but relay K4 remains energized through circuit point E.

When the completed frame advances and clears switches L6B and L7B returning them to their open positions, circuit point E as well as the stop A retract solenoid 638 are de-energized. De-energization of stop A solenoids 638 enables spring return of valve 388 whereby air is supplied to stop cylinders 316L and 316R to extend stops A into the path of movement of the rails of the next frame. De-energization of circuit point E also de-energizes relays K4, K7 and K8. De-energization of relay K7 returns contacts K7-3 to their normally closed condition in line 630, and with switch L9 closed, relay K6 remains energized and which, in turn, maintains contacts K6-2 in line 594 open and prevents energization of relay K5 which would otherwise stop the rail conveyor by energization of solenoid 600 through line 596. De-energization of relay K7 also returns contacts K7-3 in line 606 open thereby de-energizing slat conveyor stop solenoid 604 and rail stop conveyor solenoid 600 thereby restarting the slat and rail conveyors 14 and 16, respectively. De-energization of relay K8 returns contacts K8-3 in line 590 (FIG. 15B) open to de-energize the B and C stops solenoid 586 enabling spring return of valve 386 (FIG. 13) and extension of stops B and C. Relay K9 also remains energized by its holding circuit through closed contacts K2-2 in line 642 and contacts K9-1 in line 652. Continued energization of relay K9 also holds contacts K9-2 (FIG. 15A) closed and these contacts bridge the contacts of switch L2B. De-energization of relay K4 opens contacts K4-1 in line 571 (FIG. 15A) in the clamp and nail command circuit which thus make necessary the closing of switches L, L2, L3 and L4 before the next nailing can be accomplished, contacts K9-2 being held closed across switch L2B by energized relay K9. Thus after completion of the first frame, relays K6 and K9 remain energized and both the slat and rail conveyors advance additional slats and the next pair of rails for fabrication of a subsequent frame.

As the next pair of rails advance, one of the rails opens switch L8 in line 594 (FIG. 15B) which disables relay K5 until such one rail has passed the L8 switch location. Further advancement of the one rail opens switch L9 in line 630 de-energizing relay K6 which returns contacts K6-1 and K6-3 open and supplies air to cylinders 316L and 316R to extend stops A. Opening switch L9 also disables relay K6 until such one rail of the next frame has passed the L9 switch position. Further advancement of the rails opens switches and L11 in line 608 to de-energize slat stop solenoid 604. This enables restart-up of the slat conveyor only after the rails have obtained a forward position closing switches L10 and L11 in line 606. The forward ends of the rails of the second frame thus butt the extended stops A causing the rail conveyor to stall and close switches L1 and L4. The first slat of the second frame also advances to butt extended stops B causing the slat conveyor to stall and also closes switches L2 and L3. Closing switches L1-L4 completes the clamping and nailing command circuit (with automatic nail switch 574 closed). The clamping and nailing of the rails and first slat of the second frame proceeds as previously described.

As will be recalled, at the completion of the nailing, relay K3 is energized at the end of the press stroke to retract stops B and C to enable the partially fabricated second frame to advance. Once the side rails advance sufficiently to close any one of switches L6A, L7A, L6B and L7B, circuit point E is energized and which also energizes relay K4 through line 592. Energization of relay K4 closes contacts K4-1 in line 571 (FIG. 15A) to bridge switches L4 and L1. Subsequent nailing of each successive slat in the second frame, when the machine is in automatic mode, is thereby enabled by the closing of switches L2 and L3, when the slat to be nailed is in position, and the closing of switch L2B by the preceding slat.

This invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are ththerefore intended to be embraced therein.

What is claimed and desired to be secured by United States Patent is:

1. Apparatus for fabricating a wooden frame of the type having spaced generally parallel wooden side members and a plurality of spaced wooden intermediate members extending generally perpendicular between said side members and utilizing sheet metal connector stock of the type having a plurality of teeth struck integrally therefrom and from which discrete connector plates are formed for use in joining the side and intermediate members one to the other comprising:

support structure;

a pair of press heads carried by said support structure for movement along discrete predetermined paths;

means for moving said press heads along their respective predetermined paths;

means carried by said support structure for feeding the connector stock into the paths of movement of said press heads;

cooperable means carried by said support structure and said press heads including cutting edges for cutting the stock as said press heads move along their respective paths thereby to form connector plates of predetermined length;

means for supporting the side members in generally parallel spaced side-by-side relation one to the other and automatic means for positioning the intermediate members between and generally perpendicular to the side members; means for relatively locating the press heads and the intermediate and side members such that the press heads and the joints between each intermediate member and the side members are successively located in respective opposition to one another, said locating means includes means for advancing the side members and intermediate members of the partially completed frame after each joint formation therebetween relative to and in a direction away from the press heads, means releasably engageable with the partially completed frame after each advance thereof and of the last joined intermediate member a predetermined distance from said press heads for successively arresting movement of the partially completed frame thereby to space each last joined intermediate member a specified distance from each next to be joined intermediate member;

said press heads being adapted to embed the teeth of the connector plates into one side of the joints of such adjoining intermediate and side members upon continued movement of said press heads along their respective paths and for each relative location of the press heads and the joints in opposition one to the other; and control means for automatically actuating said press head moving means to move said press heads along their predetermined paths to form the connector plates and embed the teeth thereof into one side of the joints of the side members and each succeeding intermediate member in response to each successive location of said press heads and such joints in opposition to one another.

2. Apparatus according to claim 1 including means for sensing the completion of each joint formation and providing a signal responsive thereto, means arranged in controlling relation to said engageable means and responsive to said signal to release said engageable means from engagement with the partially completed frame thereby enabling advance of the partially completed frame.

3. Apparatus according to claim 1 wherein said pair of heads comprise respective first and second press heads, third and fourth press heads carried by said support structure for movement along discrete predetermined paths, means for moving said third and fourth press heads along the latter paths, respectively, means carried by said support structure for feeding connector stock into the paths of movement of said third and fourth press heads, means for relatively locating said third and fourth press heads and the intermediate and side members such that the third and fourth press heads and the joints between each intermediate member and the side members are successively located in respective opposition to one another with the third and fourth press heads opposing the opposite side of the joints from said one side thereof, cooperable means carried by said support structure and said third and fourth press heads including cutting edges for cutting the connector stock as said third and fourth press heads move along their respective predetermdined paths thereby to form connector plates of predetermined length, said third and fourth heads being adapted to embed the teeth of the connector plates into the joints of such adjoining intermediate and side members on the opposite side of the wooden members from said first and second press heads upon continued movement of said third and fourth press heads along their respective paths and for each relative location of the third and fourth press heads and the joints in opposition one to the other; and control means for automatically actuating said third and fourth press heads moving means to move said press heads along their predetermined paths to form the connector plates and embed the teeth thereof into the opposite side of the joints of the side members and each succeeding intermediate member in response to each successive location of said third and fourth press heads and such joints in opposition to one another.

4. Apparatus according to claim 3 wherein said third and fourth press heads lie in respective opposition to said first and second press heads.

5. Apparatus according to claim 4 wherein said locating means includes means for advancing the side members and intermediate members of the partially completed frame after each joint formation therebetween in a direction away from the press heads, means releasably engageable with the partially completed frame after each advance thereof and of the last joined intermediate member a predetermined distance from said press heads for successively arresting movement of the partially completed frame thereby to space each least joined intermediate member a specified distance from each next to be intermediate member.

6. Apparatus according to claim 5 including means for sensing the completion of each joint formation and providing a signal responsive thereto, means arranged in controlling relation to said engageable means and responsive to said signal to release said engageable means from engagement with the partially completed frame thereby enabling advance of the partially completed frame.

7. Apparatus according to claim 1 wherein said feed means includes a pair of passages through which connector stock is displaced into the respective paths of movement of said press heads, each of said press heads being adapted for movement in opposite directions along its associated path and between a first position on one side of said passage and a second position on the other side thereof, and means responsive to movement of said press heads from their second positions to their first positions for actuating said feeding means to feed predetermined lengths of stock into the paths of movement of said press heads.

8. Apparatus according to claim 1 including a pair of reels for carrying the connector stock in coiled form, and means carried by said support structure mounting each of said reels for rotary movement.

9. Apparatus according to claim 1 wherein the feed means associated with each press head includes a guide member having a plurality of tines defining a plurality of laterally spaced recesses for receiving and guiding the teeth of the connector stock, and means for clamping the connector stock against the tines with the ends thereof engageable against the side of the stock from which the teeth project.

10. Apparatus according to claim 1 wherein said feeding means associated with each press head includes a guide member having a plurality of tines defining a plurality of laterally spaced recesses for receiving and guiding the teeth of the connector stock, means for clamping the connector stock against the respective tines with the ends thereof engageable against the side of the stock from which the teeth project, and means for advancing said guide means and said clamping means substantially simultaneously to locate portions of the connector stock in the respective paths of movement of said press heads.

11. Apparatus according to claim 1 including control means for actuating said locating means to locate the press heads on the one hand and the side members and each next to be joined intermediate member on the other hand such that the press heads and the joints between the side members and each next to be joined intermediate member are located in respective opposition to one another in response to formation of the joints between the side members and each immediately preceding intermediate member.

12. Apparatus according to claim 1 including means for sensing the completion of a first wooden frame and providing a signal in response thereto, and means responsive to said signal for automatically relatively locating said press heads and the side members and the first intermediate member of a second wooden frame such that the press heads and the joints between the side members and the first intermediate member of the second frame are located in opposition to one another, said control means automatically actuating said press heads moving means to move said press heads along their predetermined paths to form the connector plates and embed the teeth thereof into one side of the joints of the side members and the first intermediate member of the second frame in response to relative location of said press heads and the joints between the side members and the first intermediate member of the second frame in opposition to one another.

13. Apparatus for forming a wooden frame of the type having spaced generally parallel wooden side members and a plurality of spaced wooden intermediate members extending generally perpendicular between said side members and utilizing sheet metal connector stock of the type having a plurality of teeth struck integrally therefrom and from which discrete connector plates are formed for use in joining the side and intermediate members one to the other comprising:

conveyor means for carrying a pair of laterally spaced generally parallel wooden side members along its opposite sides and longitudinally spaced intermediate members between the side members and generally perpendicular thereto;

support structure;

a pair of press heads carried by said support structure adjacent opposite sides of said conveyor means for movement along a predetermined path, said conveyor means being adapted to advance the intermediate and side members in a direction toward said press heads;

means for moving said press heads along their respective predetermined paths;

means carried by said supporting structure for feedinng the connector stock into the paths of movement of said press heads;

cooperable means carried by said support structure and said press heads including cutting edges for cutting the stock as said press heads move along their respective paths thereby to form a connector plates of predetermined length;

means carried by said apparatus for successively automatically positioning intermediate members and, locating the joints between each succeeding intermediate member and the side members along respective opposite sides of said conveyor means in respective opposition to said press heads, said press heads being adapted to embed the teeth of the connector plates into one side of the joints of such adjoining intermediate and side members upon continued movement of said press heads along their respective paths, said locating means includes means for advancing the side members and intermediate members of the partially completed frame after each joint formation therebetween relative to and in a direction away from the press heads, means releasably engageable with the partially completed frame after each advance thereof and of the last joined intermediate member a predetermined distance from said press heads for successively arresting movement of the partially completed frame thereby to space each last joined intermediate member a specified distance from each next to be joined intermediate member; and means arranged in controlling relation to said press had moving means for automatically actuating said press head moving means to move said press heads along their predetermined paths to form the connector plates and embed the teeth thereof into one side of the joints between the side members and each succeeding intermediate member in response to each successive location of such joints in opposition to said press heads.

14. Apparatus according to claim 13 including means for sensing the completion of each joint formation and providing a signal responsive thereto, means arranged in controlling relation to said engageable means and responsive to said signal to release said engageable means from engagement with the partially completed frame thereby enabling advance of the partially completed frame.

15. Apparatus according to claim 13 wherein said pair of press heads comprise respective first and second press heads, third and fourth press heads carried by said support structure for movement along discrete predetermined paths, means for moving said third and fourth press heads along the latter paths, respectively, means carried by said support structure for feeding connector stock into the paths of movement of said third and fourth press heads, means for relatively locating said third and fourth press heads and the intermediate and side members such that the third and fourth press heads and the joints between each intermediate member and the side members are successively located in respective opposition to one another with the third and fourth press heads opposing the opposite side of the joints from said one side thereof, cooperable means carried by said support structure and said third and fourth press heads including cutting edges for cutting the connector stock as said third and fourth press heads move along their respective predetermined paths thereby to form connector plates of predetermined length, said third and fourth heads being adapted to embed the teeth of the connector plates into the joints of such adjoining intermediate and side members on the opposite side of the wooden members from said first and second press heads upon continued movement of said third and fourth press heads along their respective paths and for each relative location of the third and fourth press heads and the joints in opposition one to the other; and control means for automatically actuating said third and fourth press heads moving means to move said press heads along their predetermined paths to form the connector plates and embed the teeth thereof into the opposite side of the joints of the side members and each succeeding intermediate member in response to each successive location of said third and fourth press heads and such joints in opposition to one another.

16. Apparatus according to claim 15 wherein said third and fourth press heads lie in respective opposition to said first and second press heads.

17. Apparatus according to claim 16 wherein said locating means includes means for advancing the side members and intermediate members of the partially completed frame after each joint formation therebetween in a direction away from the press heads, means releasably engageable with the partially completed frame after each advance thereof and of the last joined intermediate member a predetermined distance from said press heads for successively arresting movement of the partially completed frame thereby to space each last joined intermediate member a specified distance from each next to be joined intermediate member.

18. Apparatus according to claim 17 including means for sensing the completion of each joint formation and providing a signal responsive thereto, means arranged in controlling a relation to said engageable means and responsive to said signal to release said engageable means from engagement with the partially completed frame thereby enabling advance of the partially completed frame.

19. Apparatus according to claim 13 wherein said feed means includes a pair of passages through which connector stock is displaced into the respective paths of movement of said press heads, each of said press heads being adapted for movement in opposite directions along its associated path and between a first position on one side of said passage and a second position on the other side thereof, and means responsive to movement of said press heads from their second positions to their first positions for actuating said feeding means to feed predetermined lengths of stock into the paths of movement of said press heads.

20. Apparatus according to claim 13 including a pair of reels for carrying the connector stock in coiled form, and means carried by said support structure mounting each of said reels for rotary movement.

21. Apparatus according to claim 13 including control means for actuating said locating means to locate the press heads on the one hand and the side members and each next to be joined intermediate member on the other hand such that the press heads and the joints between the side members and each next to be joined intermediate member are located in respective opposition to one another in response to formation of the joints between the side members and each immediately preceding intermediate member.

22. Apparatus according to claim 13 including means for sensing the completion of a first wooden frame and providing a signal in response thereto, and means responsive to said signal for automatically relatively locating said press heads and the side members and the first intermediate member of a second wooden frame such that the press heads and the joints between the side members and the first intermediate member of the second frame are located in opposition to one another, said control means automatically actuating said press hads moving means to move said press heads along their predetermined paths to form the connector plates and embed the teeth thereof into one side of the joints of the side members and the first intermediate member of the second frame in response to relative location of said press heads and the joints between the side members and the first intermediate member of the second frame in opposition to one another.

23. Apparatus for forming joints between a first elongated wooden member and a plurality of second wooden members spaced longitudinally along said first member and utilizing sheet metal connector stock of the type having a plurality of teeth struck integrally therefrom and from which discrete connector plates are formed for use in such joints comprising:

support structure;

a pair of opposed press hads carried by said support structure for movement along discrete predetermined paths toward and away from one another;

means for moving said press heads along their respective predetermined paths toward and away from one another;

means carried by said support structure for feeding the connector stock between said press heads and into the paths of movement thereof;

cooperable means carried by said support structure and said press heads including cutting edges for cutting the stock as said press hads move along their respectice paths toward one another thereby to form connector plates of predetermined length;

means for supporting the first wooden member and the second wooden members at longitudinally spaced locations along the first wooden member;

means for automatically positioning second members and relatively locating the press heads and the first and second members such that the joints between each second member and the first member are successively located between said press heads, said locating means includes means for advancing the first member and second members of the partially completed frame formed thereby after each joint formation therebetween relative to and in a direction away from the press heads, means releasably engageable with the partially completed frame after each advance thereof and of the last joined second member a predetermined distance from said press heads for successively arresting movement of the partially completed frame thereby to space each last joined second member a specified distance from each next to be joined second member;

said press heads being adapted to embed the teeth of the connector plates into opposite sides of the joints of such adjoining first and second members upon continued movement of said press heads toward one another along their respective paths and for each relative location of the press heads and the joints with the joints between the press heads; and control means for automatically actuating said press head moving means to move said press heads along their predetermined paths toward one another to form the connector plates and embed the teeth thereof into the opposite sides of the joints between the first and second members in response to each successive location of said press heads and joints with the joints between the press heads.

24. Apparatus according to claim 23 including control means for actuating said locating means to locate the press heads on the one hand and the first member and the next to be joined second member on the other hand such that the joint between the first member and next to be joined second member is located between said press heads in response to formation of the joint between the first member and the immediately preceding second member.

25. Apparatus according to claim 23 including means for sensing the completion of each joint formation and providing a signal response thereto, means arranged in controlling relation to said engageable means and responsive to said signal to release said engageable means from engagement with the partially completed frame thereby enabling advance of the partially completed frame.

26. Apparatus according to claim 23 wherein said feed means includes a pair of passages through which connector stock is displaced into the respective paths of movement of said press heads, each of said press heads being adapted for movement in opposite directions along its associated path and between a first position on one side of said passage and a second position on the other side thereof, and means responsive to movement of said press heads from their second positions to their first positions for actuating said feeding means to feed predetermined lengths of stock into the paths of movement of said press heads.

27. Apparatus according to claim 23 including a pair of reels for carrying the connector stock in coiled form, and means carried by said support structure mouting each of said reels for rotary movement.

28. Apparatus according to claim 23 werein the feed means associated with each press head includes a guide member having a plurality of tines defining a plurality of laterally spaced recesses for receiving and guiding the teeth of the connector stock, and means for clamping the connector stock against the tines with the ends thereof engageable against the side of the stock from which the teeth project.

29. Apparatus according to claim 23 wherein said feeding means associated with each press head includes a guide member having a plurality of tines defining a plurality of laterally spaced recesses for receiving and guiding the teeth of the connector stock, means for clamping the connector stock against the respective tines with the ends thereof engageable against the side of the stock from which the teeth project, and means for advancing said guide means and said clamping means substantially simultaneously to locate portions of the connector stock in the respective paths of movement of said press heads.

30. Apparatus according to claim 23 including control means for actuating said locating means to locate the press heads on the one hand and the first member and each next to be joined second member on the other hand such that the press heads and the joints between the first member and each next to be joined second member are located in respective opposition to one another in response to formation of the joints between the first member and each immediately preceding second member.

31. Apparatus according to claim 23 including means for sensing the completion of a first wooden frame and providing a signal in response thereto, and means responsive to said signal for automatically relatively locating said press heads and the first members and the initial second member of a second wooden frame such that the press heads and the joints between the first member and the initial second member of the second frame are located in opposition to one another, said control means automatically actuating said press heads moving means to move said press heads along their predetermined paths to form the connector plates and embed the teeth thereof into one side of the joints of the first member and the initial second member of the second frame in response to relative location of said press heads and the joints between the first member and the initial second member of the second frame in opposition to one another.

* * * * *

UNITED STATES PATENT AND TRADEMARK OFFICE

CERTIFICATE OF CORRECTION

PATENT NO. : 4,025,028

DATED : May 24, 1977

INVENTOR(S) : John Calvin Jureit et al

It is certified that error appears in the above-identified patent and that said Letters Patent are hereby corrected as shown below:

Column 3, line 42, "corss-" should read --cross---.

Column 6, line 19, "thickness" should read --thicknesses--.

Column 7, line 32, "plae" should read --plate--.

Column 8, line 7, after "160," first occurrence, insert -- respectively - .

Column 8, line 21, "hib" should read --hub--.

Column 13, line 35, "via conduits 450" should read --via conduit 450--.

Column 15, line 20, "lline 482" should read --line 482--.

Column 15, line 37, "ov" should read --of--.

Column 18, line 6, "it sassociated" should read --its associated--.

Column 18, line 47, "523" should read --532--.

Column 19, line 21, "slot" should read --slat--.

Column 19, line 51, "contacrs" should read --contacts--.

Column 20, line 68, "294" should read --394--.

Column 22, line 48, "15" should read --L5--.

UNITED STATES PATENT AND TRADEMARK OFFICE

CERTIFICATE OF CORRECTION

PATENT NO. : 4,025,028

DATED : May 24, 1977

INVENTOR(S) : John Calvin Jureit et al

It is certified that error appears in the above-identified patent and that said Letters Patent are hereby corrected as shown below:

Column 23, line 41, "643" should read --642--.

Column 25, line 62, "ththerefore" should read --therefore--.

Column 27, line 17, "predetermdined" should read --predetermined--.

Column 27, line 50, after "to be" insert --joined--.

Column 29, line 12, "supporting" should read --support--.

Column 29, line 13, "dinng" should read --ding--.

Column 29, line 44, "had" should read --head--.

Column 31, line 37, "hads" should read --heads--.

Column 31, line 48, "hads" should read --heads--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*